US006810230B2

(12) United States Patent
Imai et al.

(10) Patent No.: US 6,810,230 B2
(45) Date of Patent: Oct. 26, 2004

(54) ELECTROMAGNETIC INDUCTION IMAGE HEATING DEVICE AND IMAGE FORMING APPARATUS

(75) Inventors: Masaru Imai, Osaka (JP); Kenji Asakura, Kyoto (JP); Hideki Tatematsu, Hyogo (JP); Shuichi Watanabe, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/130,936

(22) PCT Filed: Sep. 27, 2001

(86) PCT No.: PCT/JP01/08485

§ 371 (c)(1),
(2), (4) Date: May 24, 2002

(87) PCT Pub. No.: WO02/29498

PCT Pub. Date: Apr. 11, 2002

(65) Prior Publication Data

US 2002/0190060 A1 Dec. 19, 2002

(30) Foreign Application Priority Data

Sep. 29, 2000 (JP) ..... 2000-300069
Apr. 10, 2001 (JP) ..... 2001-110961

(51) Int. Cl.[7] ..... G03G 15/20; H05B 6/14
(52) U.S. Cl. ..... 399/328; 219/619
(58) Field of Search ..... 399/67, 69, 328, 399/330, 336; 219/216, 619, 469

(56) References Cited

U.S. PATENT DOCUMENTS 5,506,666 A 4/1996 Masuda et al.
5,666,627 A 9/1997 Yamaguchi
5,745,833 A * 4/1998 Abe et al. ..... 399/330
5,752,148 A 5/1998 Yoneda et al. ..... 399/329
5,819,150 A 10/1998 Hayasaki et al.
5,951,903 A 9/1999 Isoyama et al. ..... 219/603
6,031,215 A 2/2000 Nanataki et al.
6,037,576 A 3/2000 Okabayashi et al.
6,049,691 A 4/2000 Abe et al.
6,137,983 A 10/2000 Okabayashi et al.
RE36,962 E 11/2000 Higashi et al.
6,181,905 B1 1/2001 Ohta et al.
6,195,525 B1 * 2/2001 Maeyama ..... 399/328

(List continued on next page.)

FOREIGN PATENT DOCUMENTS

EP 0 816 942 1/1998
EP 1 026 556 8/2000
EP 1 174 774 1/2002
JP 54-131141 10/1979
JP 4-273274 9/1992

(List continued on next page.)

*Primary Examiner*—Fred Braun
(74) *Attorney, Agent, or Firm*—Merchant & Gould P.C.

(57) ABSTRACT

An excitation coil is arranged so as to be opposed to a rotatable heat generating roller of a conductive material, and on a rear side of the excitation coil, a core of a magnetic material is provided. The core is composed of a central core that is formed continuously in a rotation axis direction of the heat generating roller, and a plurality of U-shaped cores arranged at a distance from each other in that direction. A high-frequency current is applied to the excitation coil so that the heat generating roller 1 generates heat by electromagnetic induction. An additional coil is wound around the U-shaped core. Both ends of the additional coil are connected to a switching unit. When the switching unit is brought to a connected state, under an induction current generated in the additional coil, a magnetic flux in a direction in which a magnetic flux of the excitation coil is cancelled out is generated, so that heat generation of the heat generating roller can be suppressed. The switching unit is switched over according to a width of a paper sheet to be passed and a temperature distribution in the rotation axis direction. Thus, a uniform temperature distribution of the heat generating roller in the rotation axis direction can be maintained.

53 Claims, 21 Drawing Sheets

U.S. PATENT DOCUMENTS

| | | | | | |
|---|---|---|---|---|---|
| 6,246,843 | B1 | | 6/2001 | Nanataki et al. | 399/45 |
| 6,255,632 | B1 | | 7/2001 | Yokoyama et al. | |
| 6,255,633 | B1 | * | 7/2001 | Takagi et al. | 219/619 |
| 6,278,094 | B1 | * | 8/2001 | Rindfleisch et al. | 399/330 |
| 6,377,775 | B1 | | 4/2002 | Nakayama et al. | 399/328 |
| 6,449,457 | B2 | | 9/2002 | Samei et al. | |
| 6,483,088 | B2 | * | 11/2002 | Uehara et al. | 399/330 |
| 6,577,839 | B2 | * | 6/2003 | Samei | 399/328 |
| 6,591,082 | B2 | | 7/2003 | Samei et al. | |

FOREIGN PATENT DOCUMENTS

| | | | | | |
|---|---|---|---|---|---|
| JP | 6-318001 | | 11/1994 | | |
| JP | 7-295414 | | 11/1995 | | |
| JP | 8-44228 | | 2/1996 | | |
| JP | 8-69190 | | 3/1996 | | |
| JP | 8-129313 | | 5/1996 | | |
| JP | 8-137306 | | 5/1996 | | |
| JP | 8-286539 | | 11/1996 | | |
| JP | 09-106207 | * | 4/1997 | | G03G/15/20 |
| JP | 9-171889 | | 6/1997 | | |
| JP | 9-197863 | | 7/1997 | | |
| JP | 9-281824 | | 10/1997 | | |
| JP | 9-319243 | | 12/1997 | | |
| JP | 10-031379 | * | 2/1998 | | G03G/15/20 |
| JP | 10-74007 | | 3/1998 | | |
| JP | 10-074009 | * | 3/1998 | | G03G/15/20 |
| JP | 10-106739 | | 4/1998 | | |
| JP | 10-184662 | | 7/1998 | | |
| JP | 11-297462 | | 10/1999 | | |
| JP | 11-297463 | | 10/1999 | | |
| JP | 2000-181258 | | 6/2000 | | |
| JP | 2000-206813 | | 7/2000 | | |
| JP | 2000-250338 | | 9/2000 | | |
| JP | 2000-310914 | | 11/2000 | | |
| JP | 2001313162 | * | 11/2001 | | G03G/15/20 |

* cited by examiner

ELECTROMAGNETIC INDUCTION IMAGE HEATING DEVICE AND IMAGE FORMING APPARATUS

TECHNICAL FIELD

The present invention relates to an image heating device that is used in an image forming apparatus such as an electrophotographic apparatus and an electrostatic recording apparatus and includes a heat generating source for thermally fixing an unfixed image, which employs an electromagnetic induction heating method, and an image forming apparatus using the same.

BACKGROUND ART

Image heating devices employing electromagnetic induction are disclosed in JP2000-181258 A and JP2000-206813 A FIG. 27 is a cross-sectional view of the image heating device disclosed in JP2000-181258 A. FIG. 28 is a front view showing a moving mechanism of a fixing device used in the image heating device. In FIG. 27, reference numerals 101 and 102 denote a heating roller that generates heat by induction heating and is rotated and a pressurizing roller that makes contact under pressure with the heating roller 101, respectively. A recording material (sheet) 105 is passed through a pressure-contacting portion between both the rollers 101 and 102, so that an unfixed image on the recording material 105 is fixed. Further, reference numerals 103 and 104 denote an excitation coil that is arranged on an outer periphery of the heating roller 101 and generates a high-frequency magnetic field, and a magnetic field shielding material that regulates an amount of heat to be generated, respectively.

The recording material 105 carrying the unfixed toner image is conveyed to a nip portion defined by the heating roller 101 and the pressurizing roller. Then, the toner image on the recording material 105 is fixed by heat of the heating roller 101 and pressure of the pressurizing roller 102.

The magnetic field shielding material 104 is, as shown in FIG. 28, divided into a plurality of portions in a width direction of the recording material 105. The magnetic field shielding materials 104 as the portions of the divided magnetic field shielding material 104 are housed in three separate cases, i.e. a case 104*a* arranged in a center portion so as to correspond to a passing area $P_{A4L}$ through which a JIS size A4 paper sheet is passed in a longitudinal direction, and cases 104*b* and 104*c* arranged on both outer sides of the case 104*a*. A distance between the respective outer side ends of the cases 104*b* and 104*c* corresponds to a passing area $P_{A4T}$ ($P_{A4T}>P_{A4L}$) through which a JIS size A4 paper sheet is passed in a lateral direction. The cases 104*b* and 104*c* on both outer sides can be raised or lowered by a case moving mechanism 108 that is composed of a shaft 106 with a thread groove formed on an outer periphery and a sliding portion 107 provided with an internal thread that is threaded in the thread groove. When passing A4-sized paper sheets continuously in the longitudinal direction, the cases 104*b* and 104*c* on both the outer sides are retracted upward so that the magnetic field shielding materials 104 housed therein are moved away from the excitation coil 103. Thus, in portions opposed to the cases 104*b* and 104*c*, a magnetic flux reaching the heating roller 101 is weakened, thereby allowing a temperature rise of the heating roller 101 in the portions to be suppressed. When passing an A4-sized paper sheet in the lateral direction, the cases 104*b* and 104*c* on both the outer sides are lowered. Thus, an amount of heat generated by the heating roller 101 can be made substantially uniform over the full width.

FIG. 29 shows a configuration of an induction heating circuit of an image heating device of an image forming apparatus disclosed in JP2000-206813 A. In the figure, three sets of induction heating portions, each composed of a magnetic core 201 and an induction heating coil 202, are arranged so as to be opposed to a fixing roller 203. The induction heating portion in the center is supplied with power from a center portion induction heating power supply 205, and the induction heating portions at both ends are supplied with power from an end portion induction heating power supply 207. In a center portion and an end portion, temperature detecting portions TH1 and TH2 are provided, respectively. According to a detected temperature, the power supply to each of the induction heating portions is controlled. In this configuration, when heat is radiated to a greater degree in both the end portions than in the center portion of the fixing roller 203, a larger amount of power is injected into the induction heating coils opposed to the end portions. When a larger amount of heat is lost in the center portion of the fixing roller 203 as in the case where a paper sheet of a small width is passed, a reduced amount of power is supplied to the induction heating coils opposed to the end portions. In this manner, a temperature of the fixing roller 203 in an axial direction is kept uniform.

However, the image heating device FIGS. 27 and 28) disclosed in JP2000-181258 A has presented the following problems.

First of all, in this configuration, a core of a magnetic material is not present in an inner peripheral portion of the excitation coil 103, and thus magnetic coupling between the excitation coil 103 and the heating roller 101 does not work well. Therefore, in order for the heating roller 101 to be heated to a desired temperature by induction heating, a large electric current is required, thereby making an excitation circuit costly. Furthermore, because of a configuration in which the magnetic field shielding materials 104 are moved according to a width of a paper sheet to be passed, passing various types of paper sheets results in many combinations of the magnetic field shielding material to be moved and the magnetic field shielding material not to be moved. This requires a plurality of moving mechanisms, thereby making the configuration complicated and costly. Moreover, a space for moving the magnetic field shielding materials 104 and a space for the moving mechanism are required. Thus, the fixing device is made bulky, thereby making a whole image forming apparatus bulky, which has been disadvantageous.

The image heating device (FIG. 29) disclosed in JP2000-206813 A has presented the following problems.

First of all, a plurality of the induction heating portions, each composed of the magnetic core 201 and the induction heating coil 202, and a plurality of the induction heating power supplies are required, thereby making the device costly. Further, because of a configuration in which the induction heating portions and the induction heating power supplies are provided according to the sizes of paper sheets to be passed, when passing various types of paper sheets, a cost increase becomes considerable. For example, in order to achieve the passing of paper sheets varying in size between a maximum of JIS size A3 and a minimum of a post card size, and further to achieve the feeding of A4-sized and B5-sized paper sheets in longitudinal and lateral directions, it is necessary to provide five to seven induction heating portions, thereby making the device more costly.

Furthermore, spaces for housing the plurality of the induction heating power supplies are required. Thus, the device is increased in size, which has been disadvantageous.

DISCLOSURE OF THE INVENTION

In order to solve these problems of the conventional image heating devices, it is an object of the present invention to provide an image heating device that can heat a heat generating roller uniformly in a width direction of a paper sheet to be passed. Further, it is another object of the present invention to provide an image heating device that is reduced in size and weight, in which an amount of heat generated by a heat generating roller can be controlled easily at low cost according to a width of a paper sheet to be passed. Moreover, it is still another object of the present invention to provide an image forming apparatus that includes the image heating device as a thermal fixing device.

In order to achieve the aforementioned objects, the present invention has the following configurations.

An image heating device of a first configuration according to the present invention includes a heat generating member of a conductive material, an excitation unit that is arranged in the vicinity of the heat generating member and generates an annular magnetic flux to cause the heat generating member to generate heat by electromagnetic induction, and a heat generation suppressing unit that suppresses heat generation of the heat generating member by suppressing the magnetic flux generated by the excitation unit.

According to this configuration, a distribution of an amount of heat generated in a width direction can be regulated arbitrarily so as to correspond to a width of a paper sheet and a temperature of the heat generating member. Thus, the heat generating member can be heated uniformly in the width direction of the paper sheet.

In the above image heating device of the first configuration, preferably, the heat generation suppressing unit includes a conductor arranged in a path of the annular magnetic flux generated by the excitation unit, and the conductor induces a loop-shaped electric current linking to the magnetic flux under the magnetic flux. This configuration allows the heat generation suppressing unit to be constructed easily at low cost.

Preferably, with respect to a common annular magnetic flux generated by the excitation unit, a plurality of the conductors are provided. According to this configuration, an action of the heat generation suppressing unit can be regulated more freely, thereby allowing temperature regulation of the heat generating member to be performed precisely.

Preferably, the excitation unit includes an excitation coil arranged so as to be opposed to the heat generating member and a core of a magnetic material. This configuration allows the heat generating member to generate heat efficiently.

Preferably, the heat generation suppressing unit includes an additional coil wound around the core. According to this configuration, magnetic coupling between the excitation unit and the heat generation suppressing unit can be enhanced, thereby allowing the action of the heat generation suppressing unit to be enhanced. Further, the heat generation suppressing unit can be constructed easily at low cost and reduced in size. Moreover, changing a wire constituting the coil and how the wire is wound makes it easy to change a heat generation suppressing effect desirably.

An image heating device of a second configuration according to the present invention includes a heat generating member of a conductive material, an excitation unit, and a heat generation suppressing unit. The heat generating member has a rotatable cylindrical face. The excitation unit includes an excitation coil arranged so as to be opposed to the heat generating member and a core of a magnetic material and generates an annular magnetic flux to cause the heat generating member to generate heat by electromagnetic induction. The heat generation suppressing unit suppresses heat generation of the heat generating member by suppressing a magnetic flux generated by the excitation unit. The excitation coil is formed of a wire wound in the following manner. In end portions of the cylindrical face of the heat generating member in a rotation axis direction, the wire is wound along outer peripheral faces of the end portions. In portions other than the end portions, the wire is wound along a generatrix direction of the cylindrical face. The core is arranged so as to cover the excitation coil in a rotation direction of the cylindrical face, on an opposite side of the heat generating member with respect to the excitation coil. The core includes a magnetically permeable portion opposed to the heat generating member through the excitation coil and an opposing portion opposed to the heat generating member without interposing the excitation coil between them. The heat generation suppressing unit includes an additional coil wound around the core.

According to this configuration, the annular magnetic flux passing through the core, which is generated by the excitation coil, is suppressed, so that a temperature of the heat generating member in the rotation axis direction is made uniform. Further, by changing a specification of the additional coil, the degree to which a magnetic flux generated by the excitation unit is suppressed easily can be set arbitrarily.

In the above image heating device, preferably, both ends of the additional coil are short-circuited. According to this configuration, a change in the annular magnetic flux generated by the excitation unit causes an induction current to be generated in the additional coil, so that a magnetic flux that suppresses the annular magnetic flux is generated. As a result, the heat generation in a portion of the heat generating member can be suppressed, which corresponds to a portion in which the additional coil is provided.

Furthermore, in the above image heating device, preferably, the heat generation suppressing unit further includes a switching unit connected in series to the additional coil. According to this configuration, an amount of heat generated by the heat generating member in the rotation axis direction can be regulated at any time according to a paper width and a temperature of the heat generating member.

Preferably, the additional coil is wound around the magnetically permeable portion. According to this configuration, magnetic coupling between the excitation unit and the heat generation suppressing unit is enhanced, thereby allowing the action of the heat generation suppressing unit to be enhanced. Further, the heat generation suppressing unit can be constructed easily at low cost and reduced in size. Moreover, changing the wire constituting the coil and how the wire is wound makes it easy to change the heat generation suppressing effect desirably.

Preferably, the core includes a plurality of the magnetically permeable portions, and the additional coil is wound around at least one of the plurality of the magnetically permeable portions. This configuration allows a temperature of the heat generating member to be made uniform over the full width.

Preferably, a plurality of the additional coils are wound around the common magnetically permeable portion of the core. This configuration allows temperature regulation to be performed more freely and precisely.

Preferably, a pair of the additional coils are wound around the core, and the pair of the additional coils are wound in opposite directions. According to this configuration, the additional coils provided on both sides of the core suppress magnetic flux, respectively, and thus the heat generation suppressing effect is enhanced compared with the case of suppressing heat generation using the additional coil provided only on one side.

Preferably, the pair of the additional coils are wound around the core, and the pair of the additional coils and the switching unit are connected in series. According to this configuration, an action of the pair of the additional coils provided on the core can be switched over using one connecting/disconnecting unit.

Preferably, the additional coil is formed of a wire bundle of wires with insulated surfaces. According to this configuration, electric resistance with respect to a high-frequency alternating current induced in the additional coil is decreased, thereby allowing a larger electric current to be obtained using an additional coil of the same number of turns. Thus, a magnetic flux suppressing effect further can be enhanced.

Preferably, the excitation coil is formed of a wire bundle of the wires with their surfaces insulated. According to this configuration, electric resistance of the excitation coil is decreased, thereby allowing the supplied power to be converted into heat generation of the heat generating member efficiently.

Preferably, with respect to a common annular magnetic flux generated by the excitation unit, a plurality of the additional coils are provided. According to this configuration, the action of the heat generation suppressing unit can be regulated more freely, thereby allowing temperature regulation of the heat generating member to be performed precisely.

Preferably, the additional coil is arranged on an outer side of a minimum-sized paper passing area. According to this configuration, when small-sized paper sheets are passed continuously, an excessive temperature rise of the heat generating member in an area other than a passing area of the paper sheets can be prevented.

Preferably, a plurality of the additional coils are arranged on the outer side of the minimum-sized paper passing area, and the switching unit is switched over according to a width of a paper sheet to be passed. This configuration allows the heat generation suppressing unit to function so as to correspond to a width of a paper sheet to be passed. Thus, even when paper sheets varying in size are passed, a temperature of the heat generating member in the rotation axis direction always can be kept uniform.

Moreover, preferably, a temperature detecting device is provided, and the switching unit is switched over according to a temperature detected by the temperature detecting device. According to this configuration, a temperature of the heat generating member in the rotation axis direction always can be maintained uniformly without detecting a width of a paper sheet to be passed.

Preferably, when no paper is passed, the switching unit is brought to an unconnected state, and after the passing of paper is started, the switching unit is switched to a connected state. According to this configuration, after the heat generating member is heated uniformly in the rotation axis direction, the switching unit is switched over according to a paper width or a temperature, so that an excessive temperature rise in end portions of the heat generating member can be prevented, and fixing variations also can be prevented.

Preferably, at temperatures lower than a set temperature, the switching unit is brought to the unconnected state, and after the set temperature is attained, the switching unit is switched to the connected state. According to this configuration, after the heat generating member is heated uniformly in the rotation axis direction, the switching unit is switched over according to a paper width or a temperature, so that an excessive temperature rise in the end portions of the heat generating member can be prevented, and fixing variations also can be prevented.

Preferably, at temperatures lower than the set temperature, the switching unit is switched over according to a width of a paper sheet to be passed. According to this configuration, only a portion corresponding to the width of the paper sheet is heated, thereby allowing a reduction in power consumption and a shortening of temperature raising time to be achieved.

In the above image heating device of the second configuration, preferably, the core includes a plurality of substantially U-shaped cores, and the plurality of the U-shaped cores are arranged so as to cover the cylindrical face of the heat generating member in the rotation direction, at a distance from each other in the rotation axis direction of the heat generating member. According to this configuration, the excitation coil can radiate heat from gaps between the cores, and at the same time, surface areas of the cores themselves are increased, and thus heat radiation from the cores can be enhanced, thereby allowing a temperature rise of the cores and the coil to be prevented.

Preferably, the core further includes a second core portion that magnetically connects the plurality of the U-shaped cores, and the second core portion includes an opposing portion opposed to the heat generating member without interposing the excitation coil between them. According to this configuration, a magnetic flux generated by the excitation unit can be dispersed in the rotation axis direction of the heat generating member, thereby allowing an amount of heat generated by the heat generating member in the rotation axis direction to be made uniform.

Preferably, only a portion of the plurality of the U-shaped cores is provided with the additional coil. This configuration allows a temperature of the heat generating member to be made uniform in the rotation axis direction.

Preferably, substantially a center portion of the U-shaped core is connected to the second core portion. According to this configuration, in each U-shaped core, two annular magnetic fluxes can be generated, thereby allowing the heat generating member to generate heat efficiently.

Preferably, the U-shaped core is arranged so as to be inclined with respect to the rotation axis direction of the heat generating member. According to this configuration, the positions of the opposing portions in the rotation axis direction of the heat generating member can be dispersed, and the opposing portions can be arranged at a smaller distance from each other in the direction. Thus, temperature variations in the rotation axis direction of the heat generating member can be reduced.

Alternatively, the above image heating device of the second configuration may have the following configuration. That is, the core includes a plurality of substantially L-shaped cores, and the plurality of the L-shaped cores are arranged so as to cover the cylindrical face of the heat generating member in the rotation direction, at a distance from each other in the rotation axis direction of the heat generating member. According to this configuration, the excitation coil can radiate heat from gaps between the cores, and at the same time, surface areas of the cores themselves are increased, and thus heat radiation from the cores can be enhanced, thereby allowing a temperature rise of the cores and the coil to be prevented. Further, the amount of a material of the core is reduced, and thus the device can be reduced in size and weight and manufactured at lower cost. Furthermore, since a heat radiation property is improved, the L-shaped cores can be arranged at a smaller distance from each other in the rotation axis direction of the heat generating member. As a result, temperature variations in the rotation axis direction can be reduced.

Preferably, the core further includes a second core portion that magnetically connects the plurality of the L-shaped cores, and the second core portion includes an opposing portion opposed to the heat generating member without interposing the excitation coil between them. According to this configuration, a magnetic flux generated by the excitation unit can be dispersed in the rotation axis direction of the heat generating member, thereby allowing an amount of heat generated by the heat generating member in the rotation axis direction to be made uniform.

Preferably, only a portion of the plurality of the L-shaped cores is provided with the additional coil. This configuration allows a temperature of the heat generating member to be made uniform in the rotation axis direction.

Preferably, one end portion of the L-shaped core is connected to the second core portion. This configuration allows one annular magnetic flux to be generated in each of the L-shaped cores. Thus, in the heat generating member, a difference between the amounts of heat generated in a portion opposed to the L-shaped core and a portion other than the portion opposed to the L-shaped core can be decreased, thereby allowing temperature variations in the rotation axis direction to be reduced.

Preferably, the L-shaped cores are provided in a staggered arrangement with respect to the second core portion. According to this configuration, since the heat radiation property is improved, the L-shaped cores can be arranged at a smaller distance from each other in the rotation axis direction of the heat generating member. As a result, temperature variations in the rotation axis direction can be reduced.

Preferably, the opposing portion of the core includes a convex portion protruding to a side of the heat generating member. According to this configuration, magnetic coupling between the excitation unit and the heat generating member is enhanced, thereby allowing the heat generating member to generate heat efficiently.

Preferably, the opposing portion of the second core portion includes a convex portion protruding to a side of the heat generating member, and the convex portion is inserted in a hollow portion in a winding center of the excitation coil. According to this configuration, magnetic coupling between the excitation unit and the heat generating member is enhanced, thereby allowing the heat generating member to generate heat efficiently.

An image heating device of a third configuration according to the present invention includes a heat generating member of a conductive material, an excitation power supply that generates an electric current changing over time, an excitation unit that is arranged in the vicinity of the heat generating member and supplied with the electric current from the excitation power supply to generate an annular magnetic flux so as to cause the heat generating member to generate heat by electromagnetic induction, and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current. The switching unit is switched over when an induction current generated in the conductor has a value close to zero.

According to this configuration, at the moment when an electric current of the same waveform as that of a high-frequency current fed to the excitation unit, which is induced in the conductor under the high-frequency current, has a value of substantially zero, the switching unit can be switched over. Thus, the generation of an excessively high voltage in the switching unit and the occurrence of sparking and insulation destruction can be prevented. At the same time, abrupt changes in electric current and voltage are prevented from being caused in the conductor due to switching of the switching unit, thereby allowing the generation of unwanted electromagnetic noise to be prevented.

An image heating device of a fourth configuration according to the present invention includes a heat generating member of a conductive material, an excitation power supply that generates an electric current changing over time, an excitation unit that is arranged in the vicinity of the heat generating member and supplied with the electric current from the excitation power supply to generate an annular magnetic flux so as to cause the heat generating member to generate heat by electromagnetic induction, and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current. The switching unit is switched over when an induction voltage generated in the conductor has a value close to zero.

According to this configuration, at the moment when a voltage of the same waveform as that of a high-frequency current fed to the excitation unit, which is induced in the conductor under the high-frequency current, has a value of substantially zero, the switching unit can be switched over. Thus, the generation of an excessively high voltage in the switching unit and the occurrence of sparking and insulation destruction can be prevented. At the same time, abrupt changes in electric current and voltage are prevented from being caused in the conductor due to switching of the switching unit, thereby allowing the generation of unwanted electromagnetic noise to be prevented.

In the above configuration, preferably, when switching over the switching unit, no electric current is applied to the excitation unit. According to this configuration, the switching unit can be switched over in a state where an electric current or a voltage of the same waveform as that of a high-frequency current fed to the excitation unit, which is induced in the conductor under the high-frequency current, has a value of zero. Thus, the generation of an excessively high voltage in the switching unit and the occurrence of sparking and insulation destruction can be prevented. At the same time, abrupt changes in electric current and voltage are prevented from being caused in the conductor due to switching of the switching unit, thereby allowing unwanted electromagnetic noise to be prevented.

An image heating device of a fifth configuration according to the present invention includes a heat generating member of a conductive material, an excitation power supply that generates an electric current and a voltage that change over time, an excitation unit that is arranged in the vicinity of the heat generating member and supplied with the electric current and the voltage from the excitation power supply to generate an annular magnetic flux so as to cause the heat generating member to generate heat by electromagnetic induction, and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current. The switching unit is switched over in synchronization with changes in the electric current or the voltage supplied to the excitation unit.

According to this configuration, at the moment when an electric current or a voltage of the same waveform as that of a high-frequency current fed to the excitation unit, which is induced in the conductor under the high-frequency current, has a value of substantially zero, the switching unit can be switched over. Thus, the generation of an excessively high voltage in the switching unit portion and the occurrence of sparking and insulation destruction can be prevented. At the same time, abrupt changes in electric current and voltage are prevented from being caused in the conductor due to switching of the switching unit, thereby allowing the generation of unwanted electromagnetic noise to be prevented.

An image heating device of a sixth configuration according to the present invention includes a heat generating member of a conductive material, an excitation power supply that generates an electric current changing over time, an excitation unit that is arranged in the vicinity of the heat generating member and supplied with the electric current from the excitation power supply to generate an annular magnetic flux so as to cause the heat generating member to generate heat by electromagnetic induction, and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current. The conductor is formed of a wire wound with at least one turn.

According to this configuration, a magnetic flux suppressing action is enhanced, thereby allowing the effect of controlling a temperature distribution to be enhanced. When the conductor of an increased number of turns is used, a suppressing action upon a magnetic flux generated by the excitation unit further is enhanced. Further, by changing the number of turns according to temperature ununiformity, temperature uniformity of the heat generating member in the rotation axis direction can be regulated.

In the above configuration, preferably, the wire is wound with at least two turns whose paths are different from each other in at least a portion. According to this configuration, magnetic fluxes in a plurality of positions can be controlled using the single switching unit. Thus, a controlling operation can be performed more precisely using a reduced number of the switching units, and a uniform temperature distribution can be realized.

Preferably, the respective turns of the wire are wound apart from each other. According to this configuration, an area in which the conductor is provided can be increased using a reduced amount of the wire, thereby allowing a heat generation suppressing effect of this conductor to be enhanced.

An image heating device of a seventh configuration according to the present invention includes a heat generating member of a conductive material, an excitation power supply that generates an electric current changing over time, an excitation unit that is arranged in the vicinity of the heat generating member and supplied with the electric current from the excitation power supply to generate an annular magnetic flux so as to cause the heat generating member to generate heat by electromagnetic induction, and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current. The conductor has a length in a direction along the annular magnetic flux that is greater than a thickness of the conductor in a plane perpendicular to the direction along the annular magnetic flux.

According to this configuration, while a heat generation suppressing action of the conductor is secured sufficiently, the conductor can be reduced in size and formed from a reduced amount of a material.

Preferably, the heat generation suppressing unit suppresses the magnetic flux generated by the excitation unit by generating a magnetic flux in an opposite direction to a direction of the magnetic flux generated by the excitation unit.

More specifically, preferably, the heat generation suppressing unit generates an induced electromotive force under the magnetic flux generated by the excitation unit to induce an electric current, so that a magnetic flux in a direction in which the magnetic flux generated by the excitation unit is cancelled out is generated.

According to this configuration, heat generation of the heat generating member can be suppressed by a simple method, and according to a paper width and a temperature distribution of the heat generating member in the rotation axis direction, an amount of heat generated by the heat generating member in the rotation axis direction can be controlled arbitrarily.

Preferably, the conductor includes a hollow portion through which the magnetic flux is passed. According to this configuration, using the heat generation suppressing unit that is reduced in size by reducing an amount of a material of the conductors, the capability of regulating a heat generation distribution can be secured.

Preferably, the conductor is formed of a wound wire. This configuration allows the heat generation suppressing unit to be constructed easily at low cost. Further, changing the wire and how the wire is wound makes it easy to change the heat generation suppressing effect desirably.

Alternatively, the conductor may be formed of a wound belt-like material. This configuration makes it easier to construct and mount the heat generation suppressing unit.

Preferably, the conductor has an electric conductivity of not less than $1\times10^7$ [S/m]. According to this configuration, the conductor can be prevented from generating heat under an electric current induced in the conductor. Further, an electric current value of the induced electric current becomes high, thereby allowing the heat generation suppressing effect to be enhanced.

Preferably, a magnetic material is provided on an inner side or in the vicinity of the conductor. According to this configuration, magnetic coupling between the excitation unit and the conductor is enhanced, and thus the heat generation suppressing effect provided by an electric current induced in the conductor can be enhanced.

Preferably, a distance between an end portion of the magnetic material and the conductor along the annular magnetic flux is greater than a length of the conductor along the annular magnetic flux. This configuration allows the heat generation suppressing action of the conductor to be enhanced.

Preferably, the conductor is inclined with respect to the annular magnetic flux penetrating the conductor. According to this configuration, the heat generation suppressing action of the conductor in a direction orthogonal to the annular magnetic flux can be changed continuously. Thus, an amount of heat to be generated can be controlled more precisely, thereby allowing a desired temperature distribution to be attained.

The image heating device of the present invention further may include a thin fixing belt and a fixing roller for suspending the fixing belt so that the fixing belt is suspended between the fixing roller and the heat generating member. According to this configuration, the respective materials, thicknesses, or the like of the heat generating member and the fixing belt can be set independently, thereby allowing optimum materials and thicknesses for heating, raising temperature, fixing, or the like to be set.

An image forming apparatus according to the present invention includes an image forming unit in which an unfixed image is formed on a recording material and carried by the recording material and a thermal fixing device that thermally fixes the unfixed image on the recording material. The thermal fixing device is formed of the image heating device of the present invention. Thus, an image forming apparatus can be provided that is reduced in size and weight and allows cost reduction, in which recording materials varying widely in size can be processed using a simple configuration.

BEST MODE FOR CARRYING OUT THE INVENTION

Embodiment 1

Figure 1:
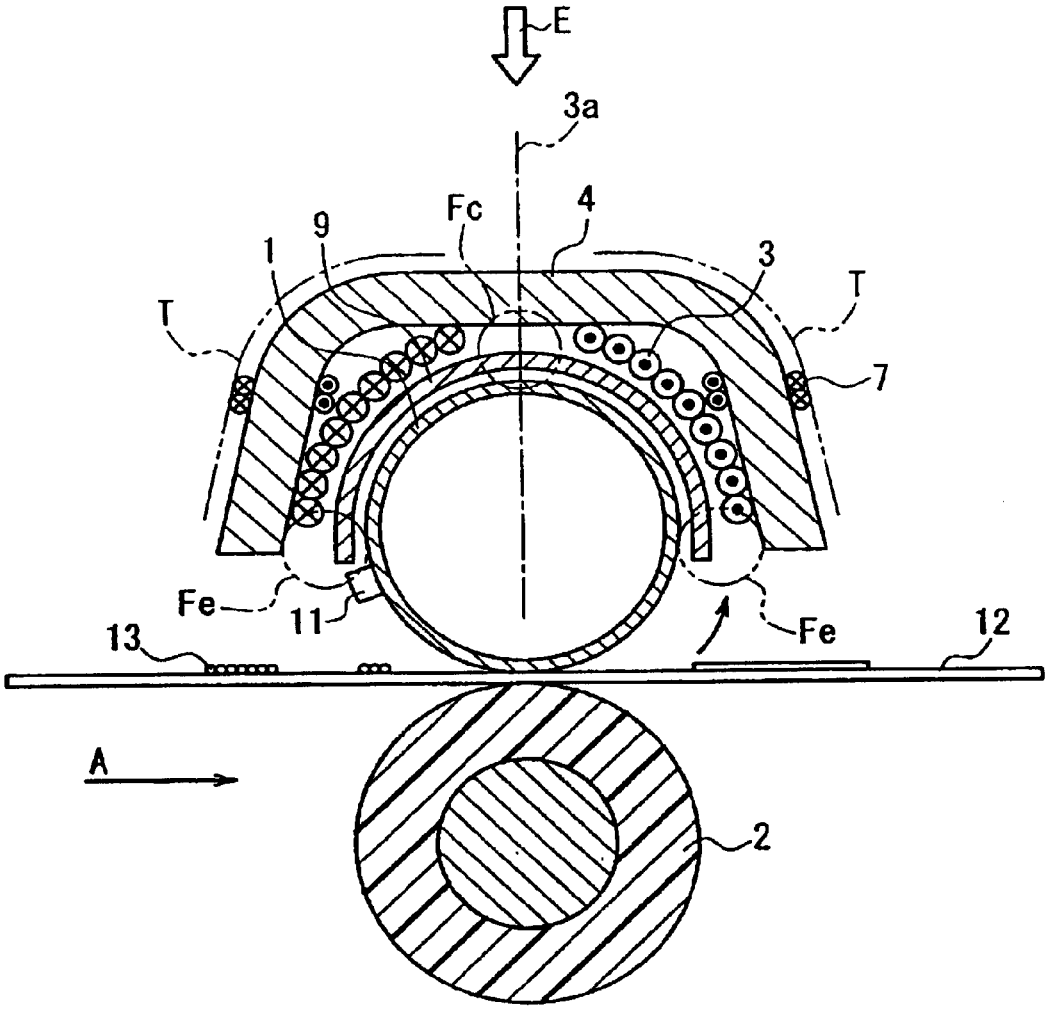
FIG. 1 is a cross-sectional view of an image heating device according to Embodiment 1 of the present invention.

FIG. 1 is a cross-sectional view of an image heating device according to Embodiment 1 of the present invention.

Figure 2:
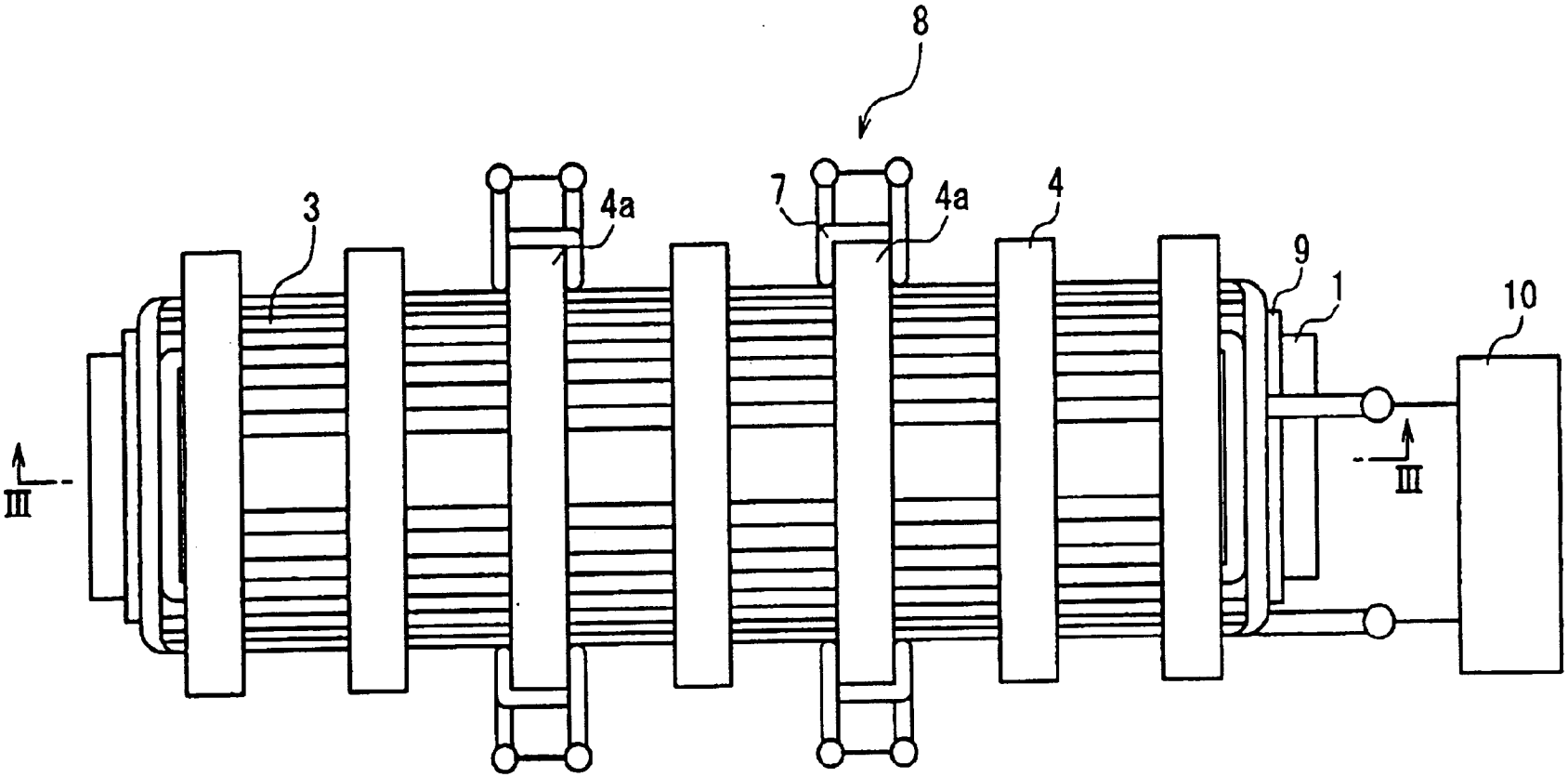
FIG. 2 is a diagram showing a configuration of a heat generating portion as seen from a direction indicated by an arrow E in FIG. 1.
Figure 3:
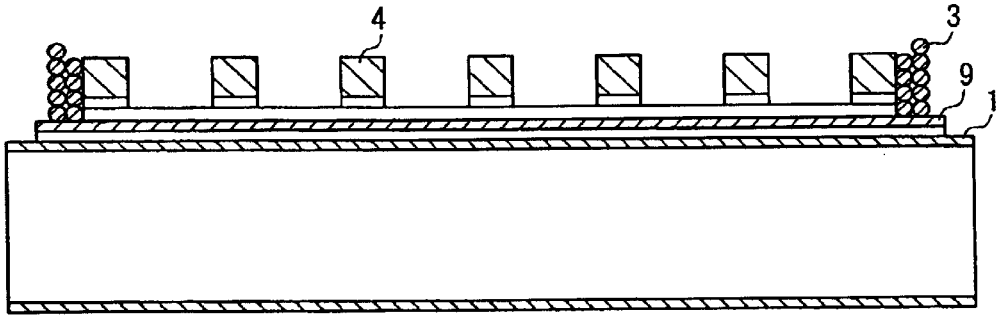
FIG. 3 is a cross-sectional view taken on line III—III of FIG. 2 for showing the heat generating portion.

FIG. 2 is a diagram showing a configuration of a heat generating portion as seen from a direction indicated by an arrow E in FIG. 1. FIG. 3 is a cross-sectional view taken on line III—III of FIG. 2 (in a plane including a rotation central axis of a heat generating roller 1 and a winding central axis of an excitation coil 3) for showing the heat generating portion.

In the figures, reference numeral 1 denotes the heat generating roller as a heat generating member, which is supported rotatably on supporting side plates that are not shown by bearings that are not shown. The heat generating roller 1 is driven to rotate by a driving mechanism of a main body of an apparatus, which is not shown. The heat generating roller 1 is formed of a 0.5-mm thick magnetic material of an alloy of iron, nickel, and chromium. In manufacturing, the heat generating roller 1 is adjusted so as to have a Curie point of 300° C. or higher.

On a surface of the heat generating roller 1, a mold releasing layer of fluorocarbon resin having a thickness of 20 $\mu$m is provided so that mold releasability is applied to the surface. The mold releasing layer may be provided as a layer of a single material or a combination of materials selected from resin and rubber having excellent mold releasability such as PTFE (polytetrafluoroethylene), PFA (tetrafluoroethylene-perfluoroalkylvinyl ether copolymer), FEP (tetrafluoroethylene hexafluoropropylene copolymer), silicone rubber, and fluorocarbon rubber. When fixing monochrome images, it is sufficient to secure only the mold releasability. However, when fixing color images, it is desirable to have elasticity. In this case, preferably, a thick rubber layer further is provided.

Furthermore, reference numeral 2 denotes a pressurizing roller as a pressurizing unit, which is formed from silicone rubber having hardness of JIS A65 degrees. The pressurizing roller 2 makes contact under pressure with the heat generating roller 1 with a predetermined pressing force (for example, of 200 N) to form a nip portion. In this state, the pressurizing roller 2 is rotated following the rotation of the heat generating roller 1. The pressurizing roller 2 may be formed of a material such as heat-resistant resin and rubber that includes fluorocarbon resin, fluorocarbon rubber, or the like. The material may be the same as a material of the heat generating roller 1 or different therefrom. Further, a surface of the pressurizing roller 2 may be coated with a single material or a combination of materials selected from resin such as PFA, PTFE, FEP, or the like and rubber so as to enhance abrasion resistance and mold releasability. Furthermore, in order to prevent heat dissipation, desirably, the pressurizing roller 2 is formed of a material having low thermal conductivity.

Furthermore, reference numeral 3 denotes an excitation coil constituting an excitation unit, which is arranged so as to be opposed to a cylindrical face on an outer periphery of the heat generating roller 1. The excitation coil 3 includes nine turns of a wire bundle composed of 60 wires of a copper wire with its surface insulated and having an outer diameter of 0.15 mm. The cross-sectional area of the wire bundle including insulating coatings of the wires is about 7 $mm^2$.

The wire bundle of the excitation coil 3 is arranged, in end portions of the cylindrical face of the heat generating roller 1 in a rotation axis (not shown) direction, in the form of an arc along outer peripheral faces of the end portions. The wire bundle is arranged, in a portion other than the end portions, along a generatrix of the cylindrical face. As shown in FIG. 1, which is a cross section orthogonal to the rotation central axis of the heat generating roller 1, the wire bundle of the excitation coil 3 is arranged tightly without being overlapped (except in the end portions of the heat generating roller 1) on an assumed cylindrical face formed around the rotation central axis of the heat generating roller 1 so as to cover the cylindrical face of the heat generating roller 1. Further, as shown in FIG. 3, which is a cross section including the rotation central axis of the heat generating roller 1, in portions opposed to the end portions of the heat generating roller 1, the wire bundle of the excitation coils 3 is overlapped in two rows and thus forced into bulges. Thus, the whole excitation coil 3 is formed into a saddle-like shape. A winding central axis 3*a* of the excitation coil 3 is a straight line substantially orthogonal to the rotation central axis of the heat generating roller 1, which passes through substantially a center point of the heat generating roller 1 in the rotation axis direction. The excitation coil 3 is formed so as to be substantially symmetrical with respect to the winding central axis 3*a*. The wire bundle is wound so that adjacent turns of the wire bundle are adhered to each other with an adhesive applied to their surface, thereby maintaining a shape shown in the figure. The excitation coil 3 is opposed to the heat generating roller 1 at a distance of about 2 mm from the outer peripheral face of the heat generating roller 1. In the cross section shown in FIG. 1, the excitation coil 3 is opposed to the outer peripheral face of the heat generating roller 1 in a large area defined by an angle of about 180 degrees with respect to the rotation central axis direction of the heat generating roller 1.

Furthermore, reference numeral 4 denotes a rear core that is arranged at a side of the excitation coil 3 opposite the side that faces the heat generating roller 1 at a distance from the excitation coil 3. As shown in FIG. 1, the rear core 4 is of U-shape substantially symmetrical with respect to the plane including the rotation axis of the heat generating roller 1 and the winding central axis 3*a* of the excitation coil 3. As shown in FIGS. 2 and 3, a plurality of the rear cores 4 are arranged at a distance from each other in the rotation axis direction of the heat generating roller 1. In this example, the rear core 4 has a width of 10 mm in the rotation axis direction of the heat generating roller 1, and seven such rear cores 4 in total are arranged at a distance of 26 mm from each other. The rear cores 4 capture magnetic flux leaking to the exterior.

As shown in FIG. 1, in both end portions and a center portion of the U-shape of each of the rear cores 4, opposing portions F are formed, which are opposed to the heat generating roller 1 without interposing the excitation coil 3 between them. In contrast to the opposing portions F, portions that are opposed to the heat generating roller 1 through the excitation coil 3 are referred to as magnetically permeable portions T. In this example, in each of the rear cores 4, three opposing portions F and two magnetically permeable portions T are provided symmetrically with respect to a center. Of the three opposing portions F, the opposing portion in the center portion is indicated by Fc and distinguished from the opposing portions in both the end portions, which are indicated by Fe.

The rear core 4 can be made, for example, of ferrite. As a material of the rear core 4, it is desirable to use a material having high magnetic permeability and high resistivity such as ferrite and Permalloy. However, a material having somewhat low magnetic permeability can be used as long as the material is of a magnetic material.

Furthermore, reference numeral 7 denotes an additional coil that includes two turns of a wire bundle composed of 20 wires of a copper wire with its surface insulated and having an outer diameter of 0.1 mm. As shown in FIG. 1, the additional coils 7 of the two turns are wound around the magnetically permeable portions T on both sides of the rear core 4, respectively. As shown in FIG. 2, the wires of a pair of the additional coils 7 provided on the rear core 4 are wound in opposite directions. Further, the additional coils 7 are provided only on two rear cores 4*a* that are the third rear cores 4 from both outer sides. The rear cores 4*a* are arranged in positions substantially symmetrical with respect to a center portion in the rotation axis direction of the heat generating roller 1. Each of the additional coils 7 with both end portions short-circuited constitutes a heat generation suppressing unit 8. In the following description, when particularly required, of the rear cores 4, the rear core with the additional coils 7 is distinguished from the rear core 4 without the additional coils 7 by using a reference character "4*a*".

Furthermore, reference numeral 9 denotes a heat insulating member having a thickness of 1 mm, which is formed from resin having high heat resistance such as PEEK (polyether ether ketones) and PPS (polyphenylene sulfide).

An alternating current of 30 kHz is applied to the excitation coil 3 from an excitation circuit 10 that is a voltage resonant inverter. An alternating current applied to the excitation coil 3 is controlled so that a temperature of a surface of the heat generating roller 1 is a predetermined fixing set temperature of 170 degrees centigrade, based on a temperature signal that can be obtained by a temperature sensor 11 held so as to be in contact with the surface of the heat generating roller 1.

In this embodiment, a maximum paper width is assumed to be a width obtained when a JIS size A4 paper sheet is passed in a longitudinal direction. Accordingly, in view of a short side width (210 mm) of the A4-sized paper sheet, the heat generating roller 1 has a length of 260 mm, a distance between outermost ends of two rear cores 4 that are arranged on outermost sides is 226 mm, a width between both outermost ends of the excitation coil 3 is 245 mm, and the heat insulating member 9 has a width of 250 mm.

In an image forming apparatus including a thermal fixing device with the above configuration, a recorded image can be obtained in the following manner. That is, an unfixed toner image is formed on a surface of a recording sheet (recording material; hereinafter, may be referred to as a "paper sheet") 12 by an image forming unit that is not shown. Then, as shown in FIG. 1, the recording sheet 12 is allowed to enter in a direction indicated by an arrow A, so that toner 13 on the recording sheet 12 is fixed to form the recorded image.

Figure 4:
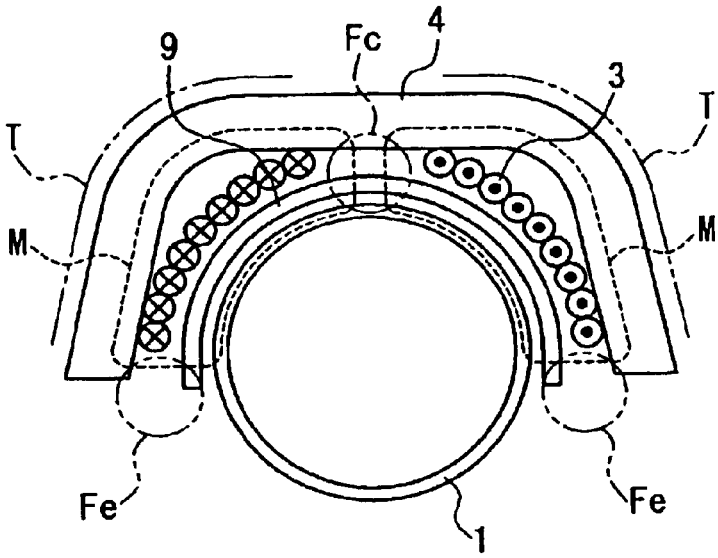
FIG. 4 is a cross-sectional view for explaining a mechanism in the image heating device according to Embodiment 1 of the present invention, in which an excitation coil causes a heat generating roller to generate heat by electromagnetic induction.

In this embodiment, the excitation coil 3 described above causes the heat generating roller 1 to generate heat by electromagnetic induction. In the following description, the heat generating action will be explained with reference to FIG. 4.

A magnetic flux M generated by the excitation coil 3 under an alternating current from the excitation circuit 10 enters the heat generating roller 1 from the opposing portion Fe in the end portion of the rear core 4. Under magnetism of the heat generating roller 1, the magnetic flux M passes through the heat generating roller 1 in a peripheral direction as shown by a dashed line M in the figure. Then, the magnetic flux M enters the rear core 4 from the opposing portion Fc, in which the rear core 4 is opposed to the heat generating roller 1, and reaches the opposing portion Fe in the end portion via the magnetically permeable portion T. In each of the rear cores 4, a pair of the annular magnetic fluxes M described above are formed symmetrically with respect to each other. The pair of the magnetic fluxes M are in opposite directions. The magnetic flux M is generated and disappears repeatedly under an alternating current from the excitation circuit 10. Most of the induction current generated due to a change in the magnetic flux M flows only to the surface of the heat generating roller 1 by a skin effect to generate Joule heat.

In this embodiment, as shown in FIG. 2, a plurality of the rear cores 4 of a small width are arranged at a uniform distance from each other in the rotation axis direction of the heat generating roller 1. Since the rear cores 4 are provided, a magnetic flux flowing in the peripheral direction on a rear side (at a side of the excitation coil 3 opposite the side that faces the heat generating roller 1) of the excitation coil 3 is concentrated at the rear core 4. Accordingly, the magnetic flux hardly flows in the air between the adjacent rear cores 4. Because of this, the magnetic flux entering the heat generating roller 1 is likely to be concentrated in a portion opposed to the rear core 4. Thus, an amount of heat generated by the heat generating roller 1 is prone to be larger in the portions opposed to the rear cores 4.

Figure 5:
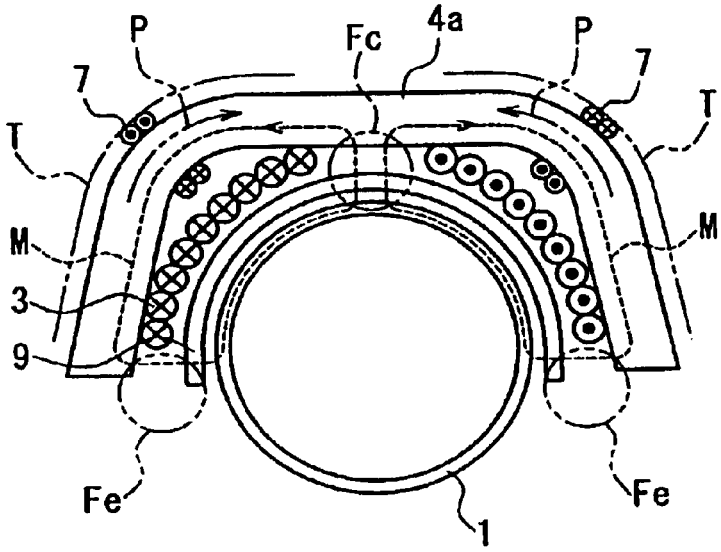
FIG. 5 is a cross-sectional view for explaining an action of a heat generation suppressing unit in the image heating device according to Embodiment 1 of the present invention.

In the following description, an action of the additional coil 7 will be explained with reference to FIG. 5. At one moment when the excitation coil 3 is energized, a pair of the magnetic fluxes M in directions indicated by arrows have been generated by the excitation coil 3. When the magnetic fluxes M pass through the rear core 4*a*, in each of the additional coils 7, which is wound around an outer periphery of the rear core 4*a* in a path of the magnetic flux M, an induced electromotive force is generated due to a change in the magnetic flux M. Since both the end portions of the additional coil 7 are short-circuited, under the induced electromotive force, a loop-shaped induction current linking to the magnetic flux M is generated in the additional coil 7. In the rear core 4*a*, a magnetic flux P in an opposite direction (namely, a direction in which the magnetic flux M is cancelled out) to the direction of each of the magnetic fluxes M is generated under the current.

The pair of the additional coils 7 wound around the rear core 4*a* are, as described earlier, wound in opposite directions. Accordingly, each of the magnetic fluxes P generated by the pair of the additional coils 7 is in the opposite direction to the corresponding direction of the pair of the magnetic fluxes M. As a result, in FIG. 5, the magnetic fluxes M generated, respectively, on right and left sides of the rear core 4*a* are suppressed by the magnetic fluxes P generated in the additional coils 7 on the right and left sides under the induced electromotive forces, respectively. Thus, the magnetic fluxes M in the rear core 4*a* with the additional coils 7 become smaller than the magnetic fluxes M in the rear core 4 without the additional coils. Hence, in the rotation axis direction of the heat generating roller 1, an amount of heat generated in a portion opposed to the rear core 4*a* with the additional coils 7 is smaller than an amount of heat generated in a portion opposed to the rear core 4 without the additional coils 7.

In both the end portions of the heat generating roller 1, heat is removed due to heat transfer by bearing portions or the like that are not shown, and thus temperatures of the end portions are prone to be decreased. In this embodiment, of the seven rear cores arranged in the rotation axis direction, the two rear cores 4*a* arranged close to the center portion are provided with the additional coils 7 (FIG. 2). This allows an amount of heat generated in the center portion of the heat generating roller 1 to be suppressed. As a result, a temperature of the heat generating roller 1 can be made uniform over the full width.

As the additional coil 7, the wire bundle composed of 20 wires is used, and thus the additional coil 7 has low electric resistance with respect to a high-frequency alternating current. This allows a large induction current to be obtained, thereby allowing a magnetic flux suppressing action to be enhanced.

Generally, as the wire bundle used in the additional coil 7, a wire bundle composed of 1 to 50 wires having an outer diameter of Φ 0.1 mm to 0.5 mm can be used. When using a wire having an outer diameter of less than 0.1 mm, there is a possibility of a broken wire due to a load ascribable to the mechanism. On the contrary, when using a wire having an outer diameter of more than 0.5 mm, electric resistance with respect to a high-frequency alternating current becomes greater, and thus there is a possibility that an excessively large amount of heat is generated by the additional coil 7. When the number of the wires constituting the wire bundle is large, the wire bundle becomes thicker. This makes it difficult to wind the additional coil 7 into an arbitrary shape and to obtain a predetermined effect in a predetermined space. By using a wire bundle having an outer diameter of roughly not more than 2 mm, these conditions can be satisfied.

In this embodiment, the additional coil 7 of two turns is wound around the rear core 4. The second turn of the additional coil 7 is drawn out to be short-circuited, and therefore, the number of the turns that is effective to form a magnetic circuit is 1 to 1.5. By increasing the number of the turns, a suppressing action upon the magnetic flux M generated by the excitation coil 3 can be enhanced further. Thus, by changing the number of turns depending on the degree of temperature ununiformity in the rotation axis direction of the heat generating roller 1, temperature uniformity in the rotation axis direction of the heat generating roller 1 can be regulated.

In this embodiment, as the additional coil 7, the wire bundle was composed of 20 wires having an outer diameter of 0.1 mm. However, by controlling the number of the wires constituting the wire bundle, the suppressing action upon the magnetic flux M performed by the additional coil 7 also can be controlled. Furthermore, in this embodiment, the wire bundle composed of the wires was used. However, by using a single wire (for example, a copper wire with its surface insulated and having an outer diameter of 0.5 mm) and increasing the number of turns, the same action also can be attained.

According to this embodiment, the wire bundle of the excitation coil 3 is wound so that adjacent turns of the wire bundle are adhered to each other, and thus magnetic flux does not pass between the turns of the wire bundle. Furthermore, the excitation coil 3 is opposed to the heat generating roller 1 over an area defined by an angle of about 180 degrees in the peripheral direction of the heat generating roller 1, and thus the magnetic flux M penetrates the large area of the heat generating roller 1 in the peripheral direction. Accordingly, heat is generated in the large area of the heat generating roller 1. Thus, even when a coil current is small and thus an amount of generated magnetic flux is small, a predetermined power can be supplied.

Furthermore, no magnetic flux passes between the turns of the wire bundle without passing through the heat generating roller 1, and thus all electromagnetic energy supplied to the excitation coil 3 is transmitted to the heat generating roller 1 without leaking. Thus, predetermined power can be supplied efficiently to the heat generating roller 1 using a small amount of electric current. Furthermore, the adjacent turns of the wire bundle are adhered to each other, and thus the excitation coil 3 can be reduced in size.

Furthermore, the whole wire bundle of the excitation coil 3 is positioned in the vicinity of the heat generating roller 1, and thus the magnetic flux M generated under a coil current is transmitted efficiently to the heat generating roller 1. An eddy current generated in the heat generating roller 1 under the magnetic flux flows so as to cancel out a change in the magnetic flux M generated by the coil current. Since the coil current and the eddy current generated in the heat generating roller 1 are dose to each other, the effect of canceling each other out is considerable, and thus a magnetic field generated in a peripheral space under all the electric currents is suppressed.

As for the wire bundle used in the excitation coil 3, the same configuration also can be attained by using a wire bundle composed of 50 to 200 wires having an outer diameter of Φ 0.1 mm to 0.3 mm. When using a wire having an outer diameter of less than 0.01 mm, there is a possibility of a broken wire due to a load ascribable to the mechanism. On the contrary, when using a wire having an outer diameter of more than 0.3 mm, electric resistance with respect to a high-frequency alternating current becomes greater, and thus there is a possibility that an excessively large amount of heat is generated by the excitation coil 3. When the number of the wires constituting the wire bundle is less than 50, electric resistance becomes greater because of a small cross-sectional area, and thus an excessively large amount of heat is generated by the excitation coil 3. On the contrary, when the number of the wires is more than 200, the wire bundle becomes thicker. This makes it difficult to wind the excitation coil 3 into an arbitrary shape, and to attain a predetermined number of turns in a predetermined space. By using a wire bundle having an outer diameter of roughly not more than 5 mm, these conditions can be satisfied, and the excitation coil 3 can be wound with an increased number of turns in a small space. Thus, a required amount of power can be supplied to the heat generating roller 1 using the excitation coil 3 that is reduced in size.

Since the rear core 4 is provided, only in gap portions (the opposing potions F) between the heat generating roller 1 and the rear core 4, magnetic flux passes through the air of low magnetic permeability. Therefore, the inductance of the excitation coil 3 is increased, and a greater amount of the magnetic flux M generated by the excitation coil 3 is introduced to the heat generating roller 1. This enhances magnetic coupling between the heat generating roller 1 and the excitation coil 3. Thus, a larger amount of power can be injected to the heat generating roller 1 using the same amount of electric current.

Furthermore, almost all the magnetic flux on the rear side of the excitation coil 3 passes through an inner portion of the rear core 4, and thus the magnetic flux can be prevented from being leaked to a rear side of the rear core 4. Thus, heat generation in peripheral conductive members by electromagnetic induction can be prevented, and at the same time, unwanted radiation of electromagnetic waves can be prevented.

Furthermore, all the magnetic flux at the rear of the excitation coil 3 pass through the inner portion of the rear core 4, and thus by providing the additional coils 7 in the magnetically permeable portions T of the rear core 4, the magnetic fluxes M passing through the heat, generating roller 1 in the peripheral direction can be suppressed. Thus, the heat generation distribution of the heat generating roller 1 can be controlled using the additional coil 7 of a considerably small size.

The cross-sectional area of the magnetically permeable portion T of the rear core 4 in a plane perpendicular to the direction of the magnetic flux M is set so that a density of the magnetic flux M generated by the excitation coil 3 is not higher than a saturation flux density of a material of the rear core 4. More specifically, the area is set so that a magnetic flux density of the magnetic flux M obtained when the magnetic flux M is highest is about 80% of a saturation flux density of ferrite that is a material of the rear core 4. The ratio of the magnetic flux density obtained when the magnetic flux M is highest to the saturation flux density is, preferably, not more than 100%. However, from a practical viewpoint, desirably, the ratio is set so as to fall within a range from 50% to 85%. When the ratio is too high, in some cases, the density of the magnetic flux M becomes higher than the saturation flux density due to variations of environments and members. In such cases, the magnetic flux M also flows to a side behind the rear core 4 to heat peripheral members. On the contrary, when the ratio is too low, apparently, costly ferrite is used more than necessary, thereby making the device costly.

Furthermore, in the rotation axis direction of the heat generating roller 1, the plurality of the equal-sized rear cores 4 are arranged uniformly at a large uniform distance from each other. Therefore, there is no possibility that heat is stored in the rear cores 4, the excitation coil 3, and the additional coils 7. Furthermore, nothing hinders heat from being radiated from the respective outer surfaces of the rear cores 4, the excitation coil 3, and the additional coils 7. Therefore, the magnetic permeability of the device as a whole can be prevented from being decreased abruptly as a result of a decrease in the saturation flux density of the ferrite as the material of the rear core 4, which is attributable to a temperature rise caused by stored heat. Further, a short circuit among the wires constituting the excitation coil 3 and the additional coils 7 can be prevented from occurring due to melting of the insulating coatings of the wires. Thus, the heat generating roller 1 can be kept stably at a predetermined temperature for a long time.

Furthermore, the excitation coil 3 is formed so that the wire bundles of the excitation coil 3 overlap each other at both the end portions of the heat generating roller 1 in the rotation axis direction. Therefore, within a limited dimension in the rotation axis direction, the excitation coil 3 can be arranged uniformly in the rotation axis direction so as to secure a larger area. Thus, a heat generation distribution of the heat generating roller 1 in the rotation axis direction can be made uniform. In other words, while an area in which the heat generating roller 1 can generate heat uniformly in the rotation axis direction is secured, the excitation coil 3 can be reduced in dimension in the direction, thereby allowing the whole device to be reduced in size.

Moreover, in this embodiment, the respective dimensions in the rotation axis direction of the heat generating roller 1 in ascending order are: a maximum paper width, a distance between the outermost ends of both the outermost rear cores 4, a distance between the outermost ends of the excitation coil 3, a width of the heat insulating member 9, and a length of the heat generating roller 1. The width of the heat insulating member 9 is greater than the width of the excitation coil 3 and the distance between the outermost ends of both the outermost rear cores 4. Therefore, the rear core 4 is opposed to the heat generating roller 1 through the heat insulating member 9, and thus even when the rear core 4 is arranged closer to the heat generating roller 1, a temperature rise of the rear core 4 can be prevented.

Furthermore, when the width of the excitation coil 3 is greater than the length of the heat generating roller 1, magnetic flux passes through conductive members arranged in the end portions of the heat generating roller 1 such as side plates that are not shown in the figure. Therefore, the peripheral members generate heat, and a ratio of energy transmitted to the heat generating roller 1 is decreased. In this embodiment, the length of the heat generating roller 1 is greater than the width of the excitation coil 3, and thus almost all magnetic flux generated from the excitation coil 3 reaches the heat generating roller 1. Thus, the electromagnetic energy supplied to the excitation coil 3 can be transmitted efficiently to the heat generating roller 1. Further, when the width of the excitation coil 3 is greater than the length of the heat generating roller 1, magnetic flux passes in an axial direction from an end face of the heat generating roller 1, and thus an eddy current density of the end face of the heat generating roller 1 is increased. As a result, an excessively large amount of heat is generated in the end portion, which also is disadvantageous. By using the heat generating roller 1 whose length is greater than the width of the excitation coil 3, the aforementioned problem also can be prevented from occurring.

The rear core 4 is not limited to the above configuration in which a plurality of the substantially U-shaped ferrite materials of a uniform thickness are arranged. For example, the rear core 4 may be configured as one body with a plurality of holes, which is formed continuously in the rotation axis direction of the heat generating roller 1. Further, a plurality of ferrite blocks may be provided so that each of the ferrite blocks is distributed isolatedly on the rear side of the excitation coil 3.

The foregoing description was directed to an example in which the heat generation suppressing unit was configured using the additional coils 7. However, the heat generation suppressing unit of the present invention is not limited to the additional coil 7 as long as the unit is formed of a conductor arranged in a path of the annular magnetic flux M generated by the excitation coil 3, which can induce a loop-shaped electric current linking to the magnetic flux M under the magnetic flux M.

Figure 6:
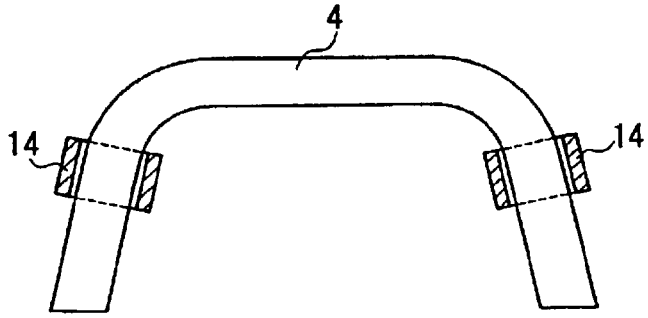
FIG. 6 is a cross-sectional view showing another example of a configuration of the heat generation suppressing unit in the image heating device according to Embodiment 1 of the present invention.

For example, as shown in FIG. 6, additional rings 14 may be arranged in the magnetically permeable portions T of the rear core 4. The additional ring 14 is formed of a thin sheet metal formed into a loop, which has a thickness equal to the outer diameter of the wire of the additional coil 7 and a width equal to a length of an area in which the additional coil 7 is provided. By providing the additional ring 14 described above on the rear core 4, as in the case of the additional coil 7 described earlier, the following effect can be obtained. That is, an amount of heat generated in portions of the heat generating roller 1 opposed to the rear cores 4 is suppressed, thereby allowing a temperature distribution to be made uniform. Moreover, this configuration eliminates the need for a coil of a plurality of turns, thereby allowing a manufacturing process to be simplified.

Figure 7:
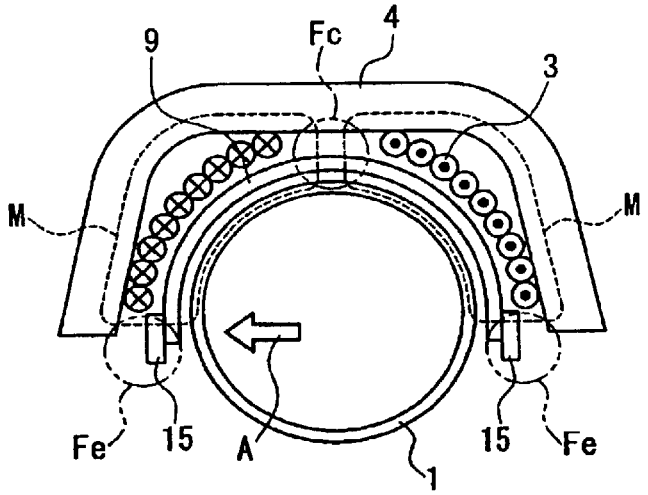
FIG. 7 is a cross-sectional view showing still another example of the configuration of the heat generation suppressing unit in the image heating device according to Embodiment 1 of the present invention.
Figure 8:
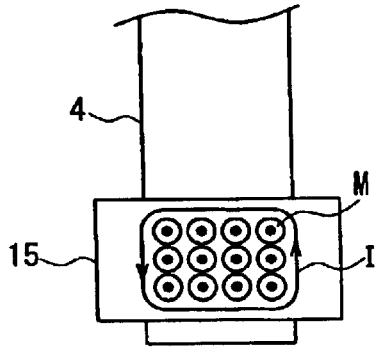
FIG. 8 is a fragmentary expanded view of the heat generation suppressing unit as seen from a direction indicated by an arrow A in FIG. 7.

Moreover, as another embodiment of the heat generation suppressing unit, as shown in FIG. 7, thin sheet metals 15 of a non-magnetic conductive material may be adhered to the heat insulating member 9 in spaces (opposing portions Fe) in which the magnetic fluxes M pass through the air. As in the aforementioned cases, this case also can provide the effect of regulating an amount of heat to be generated. This configuration eliminates the need to provide a hollow portion through which the magnetic flux M passes in an inner portion of the sheet metal 15 as in the aforementioned cases of the additional coil 7 and the additional ring 14. FIG. 8 is a fragmentary expanded view of the sheet metal 15 and the rear core 4 as seen from a direction indicated by an arrow A in FIG. 7. A change in the magnetic flux M penetrating the sheet metal 15 of a conductor induces a loop-shaped electric current I around the magnetic flux M, and a magnetic flux generated under the electric current I acts so as to cancel out the magnetic flux M generated from the excitation coil 3. Therefore, in order not to hinder generation of the loop-shaped electric current I linking to the magnetic flux M, desirably, an outer peripheral end of the sheet metal 15 forms a loop whose side portions are of an outwardly formed convex shape. As in this example, in a configuration in which the heat generation suppressing unit is not of a coil shape or a ring shape, the need for forming of a coil or a ring is eliminated, thereby allowing the manufacturing process to be simplified further.

Embodiment 2

Figure 9:
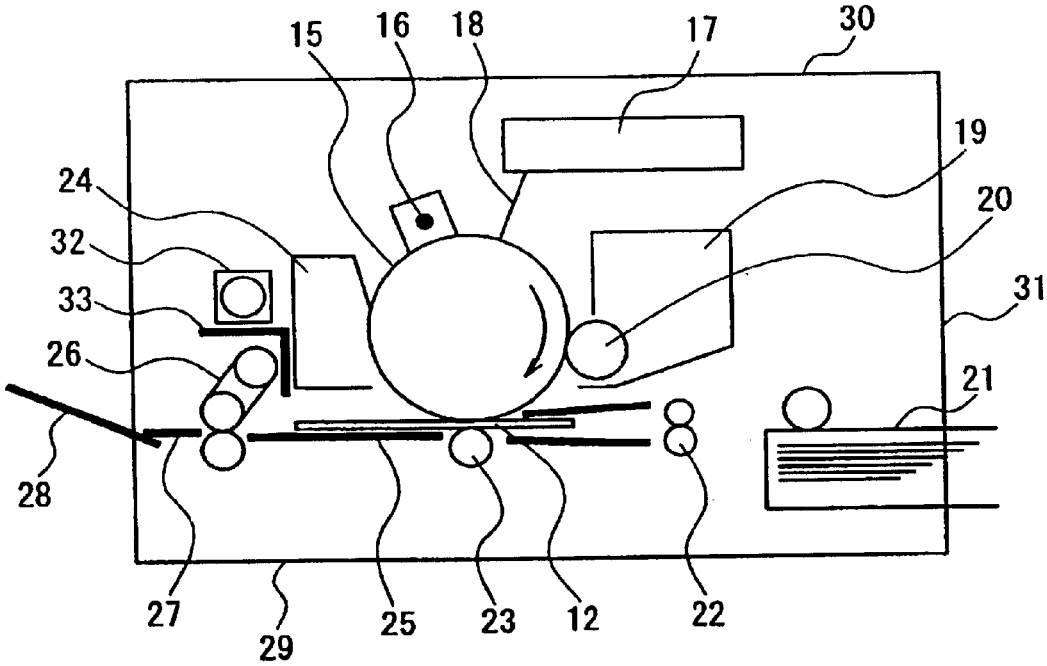
FIG. 9 is a cross-sectional view of an image forming apparatus in which an image heating device according to Embodiment 2 of the present invention is used as a thermal fixing device.
Figure 10:
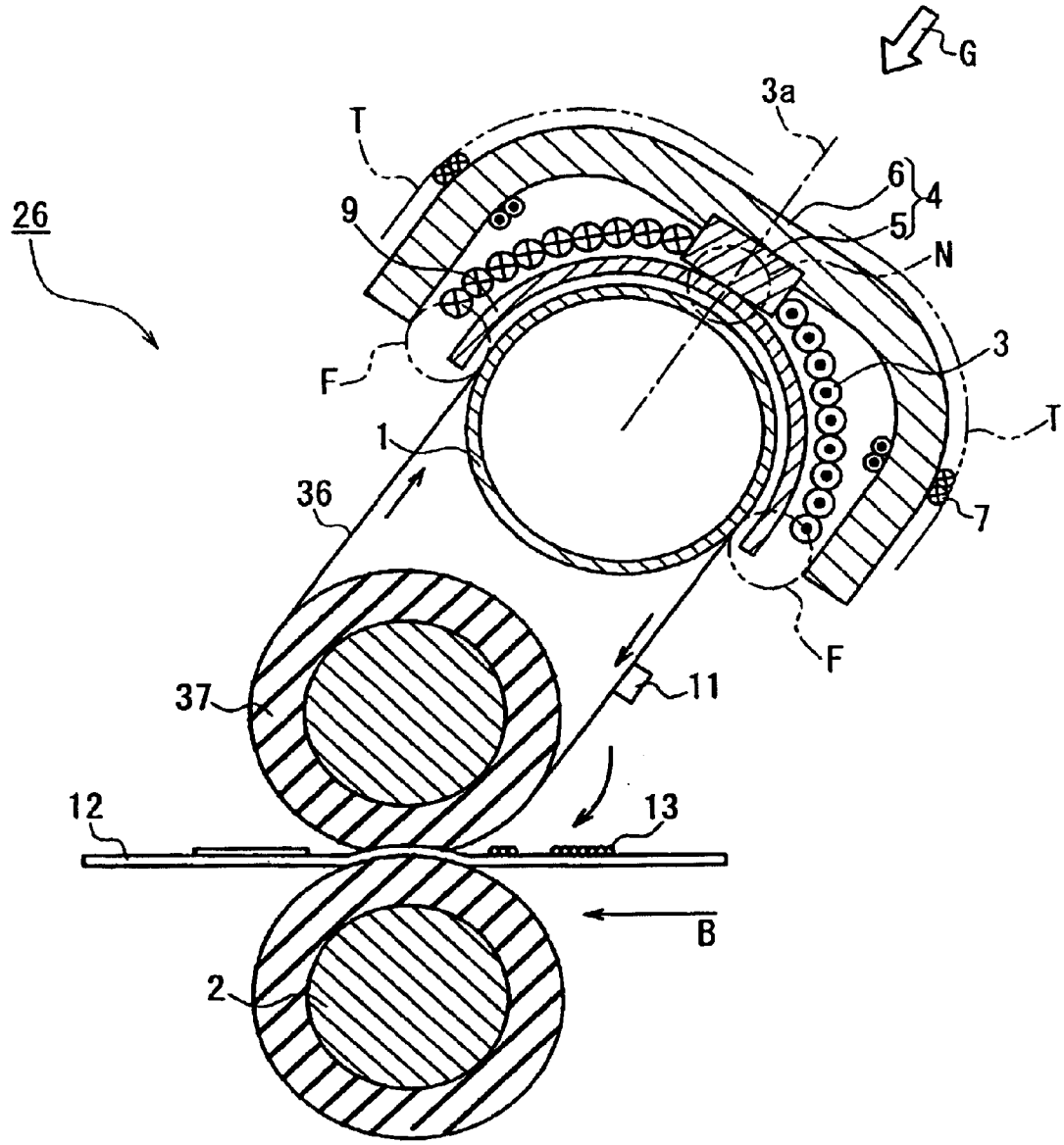
FIG. 10 is a cross-sectional view of the image heating device according to Embodiment 2 of the present invention.
Figure 11:
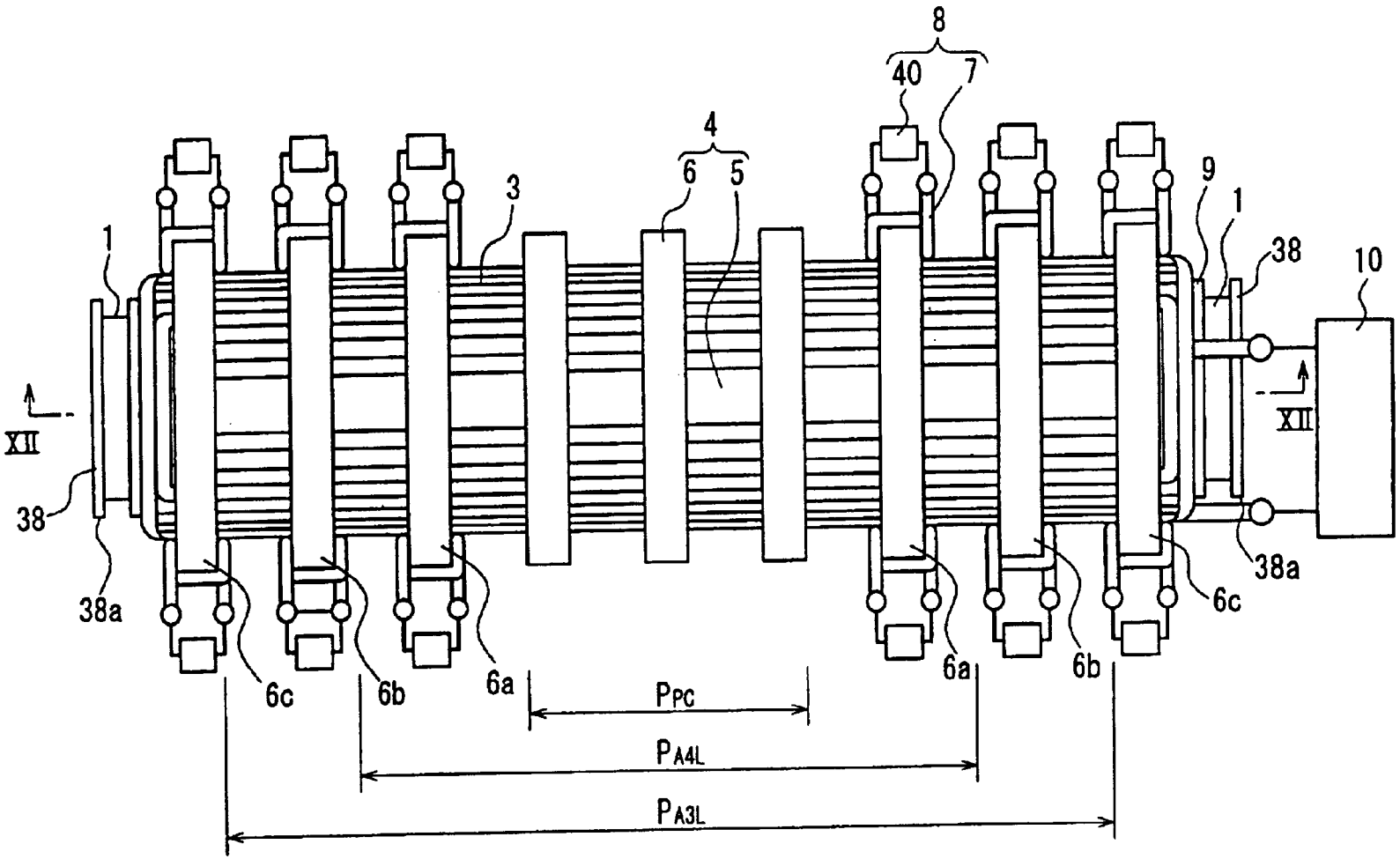
FIG. 11 is a diagram showing a configuration of a heat generating portion as seen from a direction indicated by an arrow G in FIG. 10.
Figure 12:
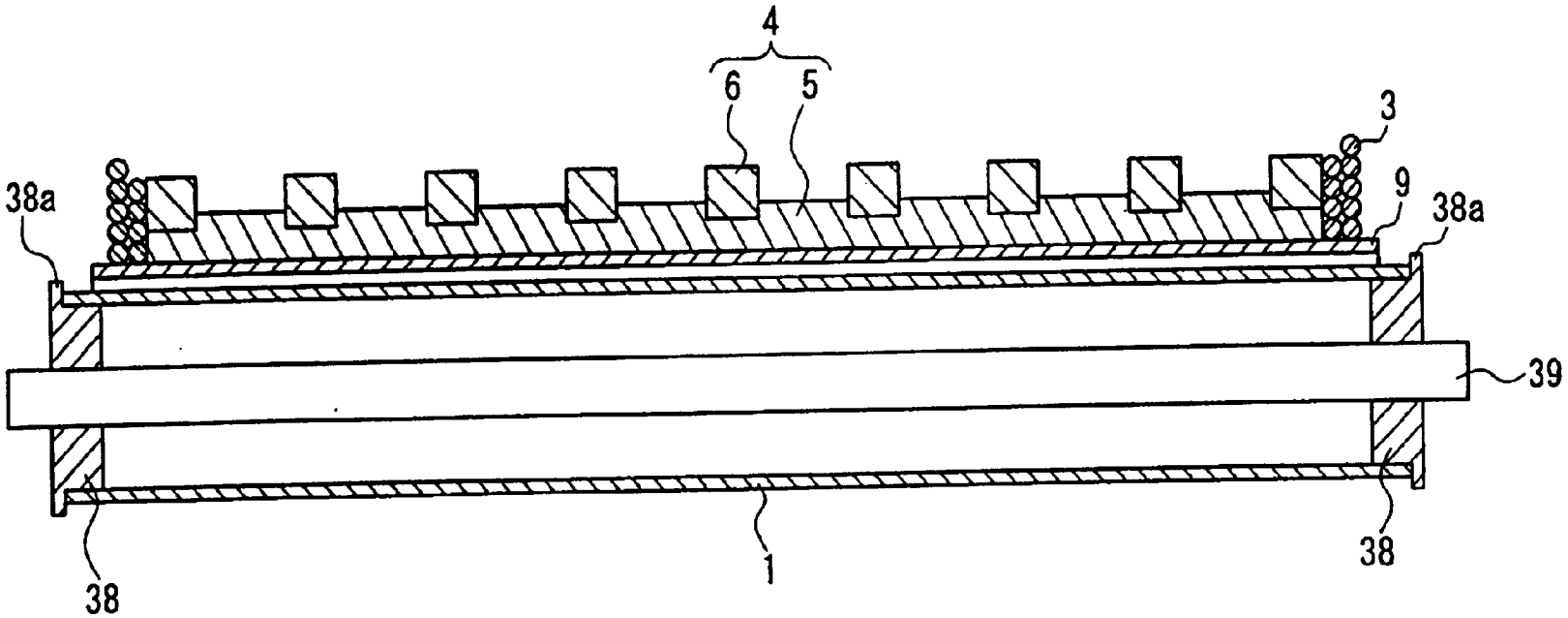
FIG. 12 is a cross-sectional view taken on line XII—XII of FIG. 11 for showing the heat generating portion.

FIG. 9 is a cross-sectional view of an image forming apparatus using an image heating device according to Embodiment 2 of the present invention as a thermal fixing device. FIG. 10 is a cross-sectional view of the image heating device according to Embodiment 2 of the present invention. FIG. 11 shows a configuration of a heat generating portion as seen from a direction indicated by an arrow G in FIG. 10. FIG. 12 is a cross-sectional view taken on line XII—XII of FIG. 11 (a plane including a rotation central axis of a heat generating roller 1 and a winding central axis 3*a* of an excitation coil 3) for showing the heat generating portion. The following description is directed to a configuration and an operation of the apparatus. In the description, like reference characters indicate like members having the same functions as those described with regard to Embodiment 1, for which duplicate descriptions are omitted.

In FIG. 9, reference numeral 15 denotes an electrophotographic photoreceptor (hereinafter, referred to as a "photosensitive drum"). The photosensitive drum 15, while being driven to rotate at a predetermined peripheral velocity in a direction indicated by an arrow, has its surface charged uniformly to a negative dark potential V0 by a charger 16. Further, reference numeral 17 denotes a laser beam scanner that outputs a laser beam 18 corresponding to a signal of image information. The charged surface of the photosensitive drum 15 is scanned by and exposed to the laser beam 18. Thus, in an exposed portion of the photosensitive drum 15, an absolute potential value is decreased to a light potential VL, and a static latent image is formed. The latent image is developed with negatively charged toner of a developer 19 and made manifest.

The developer 19 includes a developing roller 20 that is driven to rotate. The developing roller 20 with a thin toner film formed on an outer peripheral face is opposed to the photosensitive drum 15. A developing bias voltage, whose absolute value is lower than the dark potential V0 of the photosensitive drum 15 and higher than the light potential VL, is applied to the developing roller 20.

Meanwhile, a recording sheet 12 is fed one by one from a paper feeding portion 21 and passed between a pair of resist rollers 22. Then, the recording sheet 12 is conveyed to a nip portion composed of the photosensitive drum 15 and a transferring roller 23, and the timing thereof is appropriate and synchronized with the rotation of the photosensitive drum 15. Toner images on the photosensitive drum 15 are transferred one after another to the recording sheet 12 by the transferring roller 23 to which a transfer bias voltage is applied. After the recording sheet 12 is released from the photosensitive drum 15, an outer peripheral face of the photosensitive drum 15 is cleaned by removing residual materials such as toner remaining after the transferring process by a cleaning device 24 and used repeatedly for succeeding image formation.

Further, reference numeral 25 denotes a fixing guide that guides the recording sheet 12 on which the image is transferred to a thermal fixing device 26. The recording sheet 12 is released from the photosensitive drum 15 and conveyed to the thermal fixing device 26 where fixing of the transferred toner image is performed. Further, reference numeral 27 denotes a paper ejecting guide that guides the recording sheet 12, which has passed through the thermal fixing device 26, to the exterior of the apparatus. The fixing guide 25 that guides recording sheets and the paper ejecting guide 27 are formed from resin such as ABS or a non-magnetic metallic material such as aluminum. The recording sheet 12 on which the image is fixed by the fixing process is ejected to a paper ejecting tray 28.

Further, reference numerals 29, 30, and 31 denote a bottom plate of a main body of the apparatus, a top plate of the main body, and a body chassis, which constitute a unit determining the strength of the main body of the apparatus. These strength members are formed of a material in which a magnetic material of steel is used as a base material and plated with zinc.

Further, reference numeral 32 denotes a cooling fan that generates airflow in the apparatus. Furthermore, reference numeral 33 denotes a coil cover of a non-magnetic material such as aluminum, which is configured so as to cover a rear core 4 of the excitation coil 3 constituting the thermal fixing device 26.

In the following description, the image heating device according to this Embodiment 2 will be detailed, which is used as the above thermal fixing device 26.

In FIG. 10, a fixing belt 36 is a thin, endless belt having a diameter of 50 mm and a thickness of 80 $\mu$m. The base material of the fixing belt 36 is of polyimide resin. On the fixing belt 36, a silicone rubber layer having a thickness of 200 $\mu$m is provided, and further on the silicone rubber layer, a mold releasing layer of fluorocarbon resin having a thickness of 20 $\mu$m is provided so that mold releasability is provided to a surface of the fixing belt 36. As a base material, in addition to a material having high heat resistance such as polyimide and fluorocarbon resin, an ultrathin sheet metal, for example of nickel, manufactured by electroforming also can be used. Further, the mold releasing layer on the surface may be provided as a layer of a single material or a combination of materials selected from resin and rubber having excellent mold releasability such as PTFE, PFA, FEP, silicone rubber, and fluorocarbon rubber. When fixing monochrome images, it is sufficient to secure only the mold releasability. However, when fixing color images, it is desirable to apply elasticity. In this case, preferably, a silicone rubber layer further is provided as described above.

As shown in FIG. 12, the heat generating roller 1 is supported by flanges 38 formed from heat-resistant resin having low thermal conductivity such as Bakelite, which are inserted into both end portions, and a central shaft 39 penetrating the flanges 38 in their centers. This heat generating roller 1 further is supported rotatably on supporting side plates that are not shown by bearings that are not shown. In order to prevent the fixing belt 36 from snaking, the flanges 38 are provided with ribs 38*a* having a diameter greater than an outer diameter of the heat generating roller 1. The heat generating roller 1 has a diameter of 20 mm and is formed of a 0.3 mm-thick magnetic material of an alloy of iron, nickel, and chromium. In manufacturing, the heat generating roller 1 is adjusted so as to have a Curie point of 300° C. or higher.

The excitation coil 3 constituting an excitation unit is formed of nine turns of a wire bundle composed of 60 wires of a copper wire with its surface insulated and having an outer diameter of 0.15 mm. The cross-sectional area of the wire bundle including insulating coatings of the wires is about 7 $mm^2$.

The wire bundle of the excitation coil 3 is arranged, in end portions of a cylindrical face of the heat generating roller 1 in a rotation axis direction, in the form of an arc along outer peripheral faces of the end portions. The wire bundle is arranged, in a portion other than the end portions, along a generatrix of the cylindrical face. As shown in FIG. 10, which is a cross section orthogonal to a rotation central axis of the heat generating roller 1, the wire bundle of the excitation coil 3 is arranged tightly without being overlapped (except in the end portions of the heat generating roller 1) on an assumed cylindrical face formed around the rotation central axis of the heat generating roller 1 so as to cover the fixing belt 36 wound around an outer peripheral face of the heat generating roller 1. Further, as shown in FIG. 12, which is a cross section including the rotation central axis of the heat generating roller 1, in portions opposed to the end portions of the heat generating roller 1, the wire bundle of the excitation coils 3 is overlapped in two rows and thus forced into bulges. Thus, the whole excitation coil 3 is formed into a saddle-like shape. A winding central axis 3*a* of the excitation coil 3 is a straight line substantially orthogonal to the rotation central axis of the heat generating roller 1, which passes through substantially a center point of the heat generating roller 1 in the rotation axis direction. The excitation coil 3 is formed so as to be substantially symmetrical with respect to the winding central axis 3*a*.

Further, reference numeral 4 denotes a rear core that is composed of a bar-like central core (second core portion) 5 and a substantially U-shaped core 6. The central core 5 passes through the winding central axis 3*a* of the excitation coil 3 and is arranged parallel to the rotation central axis of the heat generating roller 1. The U-shaped core 6 is arranged at a distance from the excitation core 3 on an opposite side to the heat generating roller 1 with respect to the excitation coil 3. The central core 5 and the U-shaped core 6 are connected magnetically. As shown in FIG. 10, the U-shaped core 6 is of U-shape substantially symmetrical with respect to a plane including the rotation central axis of the heat generating roller 1 and the winding central axis 3*a* of the excitation coil 3. As shown in FIGS. 11 and 12, a plurality of the U-shaped cores 6 described above are arranged at a distance from each other in the rotation axis direction of the heat generating roller 1. In this example, the width of the heat generating roller 1 in the rotation axis direction is 10 mm, and nine U-shaped cores 6 in total are arranged at a distance of 29 mm from each other. The U-shaped cores 6 capture magnetic flux from the excitation coil 3, which leaks to the exterior.

As shown in FIG. 10, both ends of each of the U-shaped cores 6 are extended to areas that are not opposed to the excitation coil 3, so that opposing portions F are formed, which are opposed to the heat generating roller 1 without interposing the excitation coil 3 between them. In contrast to the opposing portion F, portions of the U-shaped core 6 that are opposed to the heat generating roller 1 through the excitation coil 3 are referred to as magnetically permeable portions T. Further, the central core 5 is opposed to the heat generating roller 1 without interposing the excitation coil 3 between them and protrudes further than the U-shaped core 6 to a side of the heat generating roller 1 to form an opposing portion N. The opposing portion N of the protruding central core 5 is inserted into a hollow portion of a winding center of the excitation coil 3. The central core 5 has a cross-sectional area of 4 mm by 10 mm. The rear core 4 is formed of the same material as that described with regard to Embodiment 1.

Further, reference numeral 9 denotes a heat insulating member having a thickness of 1 mm, which is formed from resin having high heat resistance such as PEEK and PPS.

Further, reference numeral 8 denotes a heat generation suppressing unit that is composed of an additional coil 7 provided on the U-shaped core 6 and a switching unit 40 that is connected to both ends of the additional coil 7 and formed, for example, of a switch or a relay for turning electrical connection on and off. The additional coil 7 is formed of two turns of a wire bundle composed of 20 wires of a copper wire with its surface insulated and having an outer diameter of 0.1 mm. As shown in FIG. 10, the additional coils 7 of the two turns are wound around the magnetically permeable portions T on both sides of the U-shaped core 6, respectively. As shown in FIG. 11, the wires of a pair of the additional coils 7 provided on the U-shaped core 6 are wound in opposite directions. Both ends of each of the additional coils 7 are connected to the switching units 40, respectively. As shown in FIG. 11, the heat generation suppressing units 8 are provided only on the U-shaped cores 6*a*, 6*b*, and 6*c* provided on both outer sides. The U-shaped cores 6*a*, 6*b*, and 6*c* are arranged in positions substantially symmetrical with respect to a center portion of the heat generating roller 1 in the rotation axis direction, respectively. In the following description, when particularly required, of the U-shaped cores 6, the U-shaped cores with the additional coils 7 are distinguished from the U-shaped cores without the additional coils 7 by adding letters "a", "b", and "c" to the reference numeral 6.

Alternating current is supplied to the excitation coil 3 in the same manner as in Embodiment 1. An alternating current applied to the excitation coil 3 is controlled so that a temperature of a surface of the fixing belt 36 is a predetermined fixing set temperature of 190 degrees centigrade, based on a temperature signal obtained by a temperature sensor 11 that is held so as to be in contact with the surface of the fixing belt 36.

Figure 13:
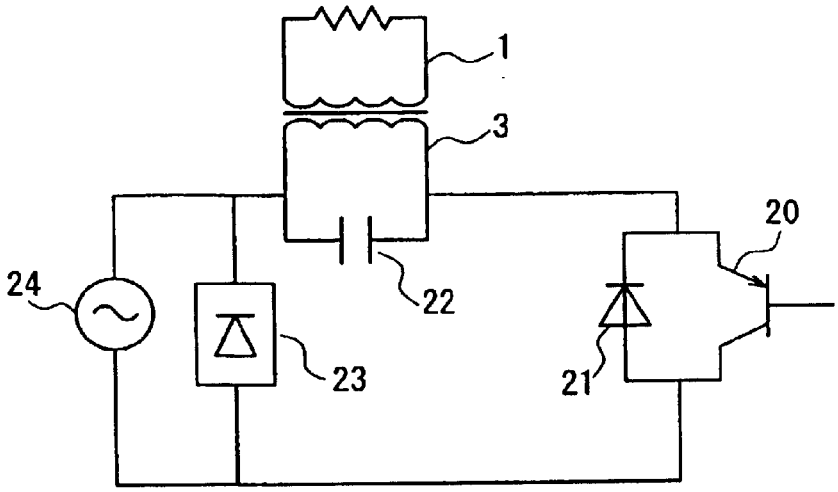
FIG. 13 is a circuit diagram showing an example of a basic configuration of an excitation circuit used in the image heating device of the present invention.

FIG. 13 shows the basic circuit of a single-ended voltage-fed resonant inverter that is used in an excitation circuit 10. An alternating current from a commercial power supply 24 is rectified in a rectifier circuit 23 and applied to the inverter. In the inverter, a high-frequency current is applied to the excitation coil 3 according to switching of a switching element 20 such as an IGBT (Insulated Gate Bipolar Transistor) by a resonant capacitor 22. Reference numeral 21 denotes a diode.

As shown in FIG. 10, the fixing belt 36 is suspended with a predetermined tensile force between a fixing roller 37 of 20 mm diameter having low thermal conductivity and the heat generating roller 1. The surface of the fixing roller 1 is formed of an elastic foam body of silicone rubber having a low hardness (JIS A30 degrees). The fixing belt 36 is rotatable in a direction indicated by an arrow.

A pressurizing roller 2 as a pressurizing unit makes contact under pressure with the fixing roller 37 through the fixing belt 36 with a predetermined pressing force (for example, of 400 N) to form a nip portion.

In this embodiment, a maximum paper width is assumed to be a width obtained when a JIS size A3 paper sheet is passed in a longitudinal direction. Accordingly, in view of a short side width (297 mm) of the A3-sized paper sheet, the fixing belt 36 has a width of 350 mm, the heat generating roller 1 has a length of 360 mm, a distance between outermost ends of two U-shaped cores 6 (U-shaped cores 6*c*) that are arranged on outermost sides is 322 mm, a width between both outermost ends of the excitation coil 3 is 342 mm, and the heat insulating member 9 has a width of 355 mm.

The recording material 12 carrying the unfixed toner image on its surface is allowed to enter the thermal fixing device having the aforementioned configuration in a direction indicated by an arrow B as shown in FIG. 10 so that the toner 13 on the recording sheet 12 is fixed.

Figure 14:
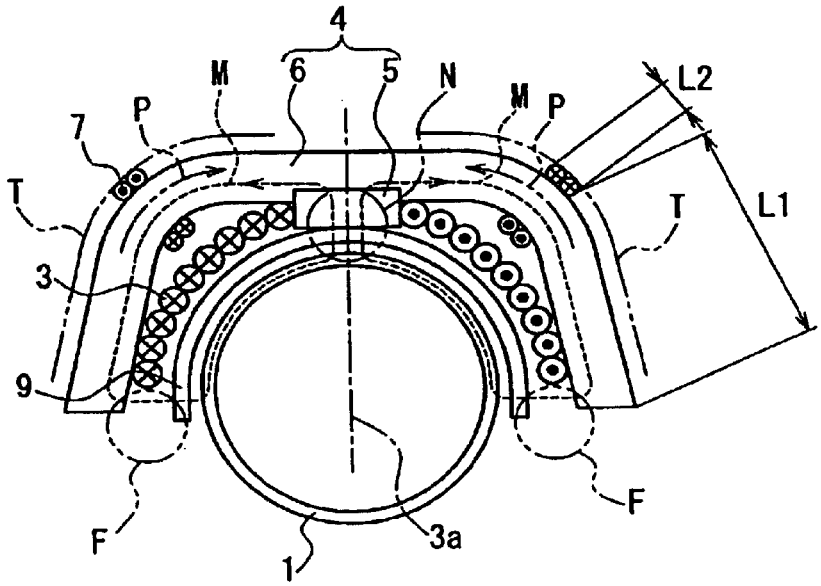
FIG. 14 is a cross-sectional view for explaining a mechanism in which a heat generating roller generates heat and an action of a heat generation suppressing unit in the image heating device according to Embodiment 2 of the present invention.

According to the aforementioned configurations of the excitation coil 3, the rear core 4, and the heat generating roller 1, the excitation coil 3 causes the heat generating roller 1 to generate heat by electromagnetic induction. Hereinafter, the heat generating action will be described with reference to FIG. 14 showing a cross section of the heat generating portion.

A magnetic flux M generated in the excitation coil 3 under an alternating current from the excitation circuit 10 enters the heat generating roller 1 from the opposing portion F in an end portion of the U-shaped core 6. Due to magnetism of the heat generating roller 1, the magnetic flux M passes through the heat generating roller 1 in a peripheral direction as shown by a dashed line M in the figure. Then, the magnetic flux M passes through the opposing portion N opposed to the heat generating roller I and enters the central core 5 to reach the opposing portion F in the end portion via the magnetically permeable portion T of the U-shaped core 6. In each of the U-shaped cores 6, a pair of the annular magnetic flux M described above are formed symmetrically with respect to each other. The pair of the magnetic flux M are in opposite directions. The magnetic flux M is generated and disappears repeatedly under the alternating current of the excitation circuit 10. Most of the induction current generated due to a change in the magnetic flux M flows only to a surface of the heat generating roller 1 by a skin effect to generate Joule heat.

In this embodiment, as shown in FIG. 11, a plurality of the U-shaped cores 6 of a small width are arranged at a uniform distance from each other in the rotation axis direction of the heat generating roller 1. When the U-shaped cores 6 are not provided with the central core 5, a magnetic flux flowing in the peripheral direction on a rear side (on an opposite side to the heat generating roller 1 with respect to the excitation coil 3) of the excitation coil 3 is concentrated at the U-shaped core 6. Accordingly, the magnetic flux hardly flows in the air between the adjacent U-shaped cores 6. Because of this, the magnetic flux entering the heat generating roller 1 is likely to be concentrated in a portion opposed to the U-shaped core 6. Thus, an amount of heat generated by the heat generating roller 1 is prone to be larger in the portions opposed to the U-shaped cores 6.

However, in this embodiment, the central core 5 forming the opposing portion N is connected magnetically to each of the U-shaped cores 6 and arranged continuously parallel to the rotation axis direction of the heat generating roller 1. Therefore, the magnetic flux M that has entered the heat generating roller 1 from the opposing portion F of the U-shaped core 6 also flows in the rotation axis direction. Thus, the magnetic flux M passing through the heat generating roller 1 is distributed uniformly in the rotation axis direction. Hence, ununiformity of an amount of heat generated by the heat generating roller 1 in the rotation axis direction is reduced.

Hereinafter, an action of the heat generation suppressing unit 8 in this embodiment will be explained.

The description is directed first to a case of passing a paper sheet of a maximum width, namely, passing a JIS size A3 paper sheet in a longitudinal direction. In this case, all the switching units 40 are set to be in an unconnected state (open state). When the excitation coil 3 is energized in this state, an induced electromotive force is generated in each of the additional coils 7 due to a change in the magnetic flux M generated by the excitation coil 3. However, since both end portions of the additional coil 7 are in the unconnected state, an induction current does not flow. Accordingly, the additional coil 7 does not generate magnetic flux under the induced electromotive force, and thus substantially an entire area of the heat generating portion of the heat generating roller 1 is heated uniformly in the rotation axis direction. As shown in FIG. 11, with respect to an A3-sized paper passing area $P_{A3L}$, the U-shaped cores 6*c* and 6*c* on both outermost sides are arranged on outer sides, and the U-shaped cores 6*b* and 6*b* as the second cores from both the outermost sides are arranged on an inner side. Since the A3-sized paper sheet being passed removes heat over substantially the full width, a temperature of the fixing belt 36 is kept uniform in a width direction by the magnetic flux M generated by the excitation coil 3.

The description is directed next to a case of passing a paper sheet of a small width such as a post card (of 105 mm width). As shown in FIG. 11, three pairs of the U-shaped cores 6*a*, 6*b*, and 6*c* on both the outer sides are arranged on outer sides of a post card passing area $P_{PC}$. In this case, all the switching units 40 provided on the U-shaped cores 6*a*, 6*b*, and 6*c* on both sides are switched to a connected state (closed state). In FIG. 14, at one moment when the excitation coil 3 is energized in this state, in the U-shaped core 6, a pair of the magnetic fluxes M in directions indicated by arrows have been generated by the excitation coil 3. In each of the additional coils 7 wound on an outer periphery of the U-shaped core 6 in a path of the magnetic flux M, an induced electromotive force is generated due to a change in the magnetic flux M. Since both the ends of the additional coil 7 are connected, a loop-shaped induction current linking to the magnetic flux M is generated in the additional coil 7 under the induced electromotive force. In the U-shaped core 6, a magnetic flux P in an opposite direction (namely, a direction in which the magnetic flux M is cancelled out) to the direction of each of the magnetic fluxes M are generated under the induction current. As a result, the magnetic fluxes M passing through the U-shaped cores 6*a*, 6*b* and 6*c* provided with the additional coils 7 are decreased, and thus an amount of heat generated in the vicinity of portions of the heat generating roller 1 that are opposed to these cores is suppressed. In this embodiment, the U-shaped cores 6*a*, 6*b*, and 6*c* on the outer sides of the post card passing area $P_{PC}$ are provided with the additional coils 7. Thus, by suppressing an amount of heat generated in both the end portions of the heat generating roller 1, in which heat is not removed by a post card, temperatures of both the end portions can be kept at almost the same temperature as that of the center portion.

Figure 15:
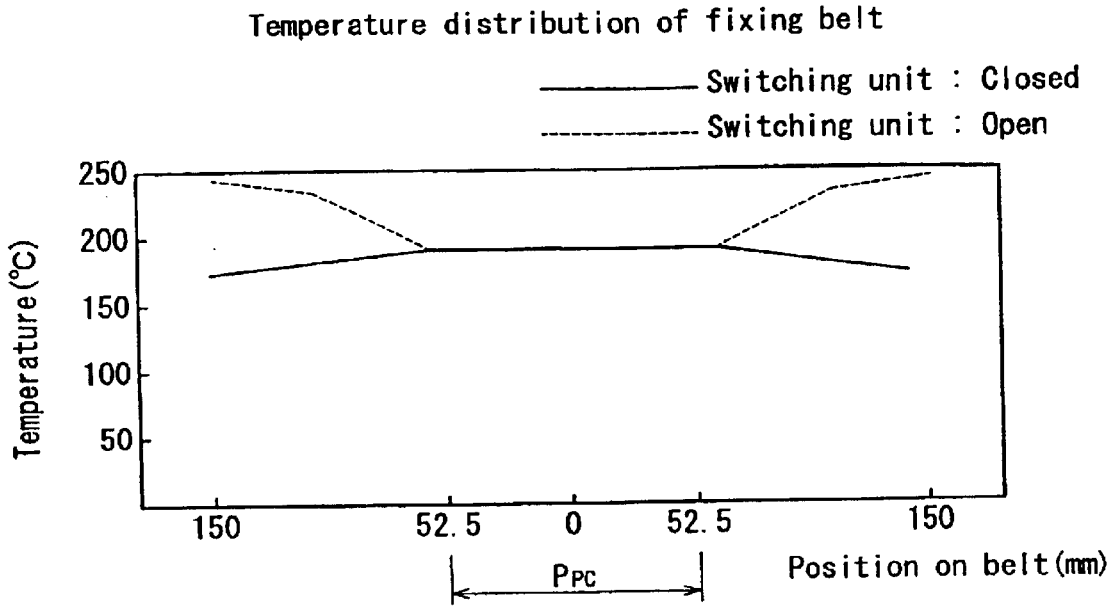
FIG. 15 is a graph of temperature distributions for explaining an effect provided by the heat generation suppressing unit in the image heating device according to Embodiment 2 of the present invention.

FIG. 15 shows temperature distributions in a direction (a direction parallel to the rotation axis direction of the heat generating roller 1) perpendicular to a moving direction of the fixing belt 36, which are obtained when post cards are passed continuously. In the figure, a vertical axis indicates a temperature, and a horizontal axis indicates a position (a center portion is assumed to be an origin point) in a width direction on the fixing belt 36. A solid line indicates a case where the heat generation suppressing units 8 are operated with all the switching units brought to the connected state. A dashed line indicates a case where the heat generation suppressing units 8 are not operated with all the switching units brought into the unconnected state. When the heat generation suppressing units 8 are operated (solid line), a temperature on the outer sides of the post card passing area $P_{PC}$ is slightly lower that a temperature in the post card passing area $P_{PC}$. When the heat generation suppressing units 8 are not operated (dashed line), a temperature on the outer sides of the post card passing area $P_{PC}$ is much higher than a temperature in the post card passing area $P_{PC}$. The fixing belt 36, the bearings, and the like can no longer resist the high temperature, so that breakage and deterioration are caused.

The following description is directed to a case where a JIS size A4 paper sheet (210 mm in the short side length) is passed in a longitudinal direction. As shown in FIG. 11, with respect to an A4-sized paper passing area $P_{A4L}$, the U-shaped cores 6*b* and 6*b* as the second cores from both the outer sides are arranged on outer sides, and the U-shaped cores 6*a* and 6*a* as the third cores form both the outer sides are arranged on an inner side. Accordingly, in this case, the switching units 40 provided on two pairs of the U-shaped cores 6*b* and 6*c* at both ends are switched to the connected state, and the switching units 40 provided on the U-shaped cores 6*a* as the third cores from both the outer sides are set to be in the unconnected state. When the excitation coil 3 is energized in this state, an amount of heat generated in the vicinity of portions of the heat generating roller 1 that are opposed to the U-shaped cores 6*b* and 6*c* is suppressed as in the above case. By suppressing an amount of heat generated in portions of the heat generating roller 1, in which no paper sheet is passed, and thus no heat is removed by the paper sheet, a temperature of the fixing belt 36 can be kept uniform over the maximum-sized paper passing area $P_{A3L}$.

Thus, the members including the fixing belt 36, the bearings, and the like can be prevented from being broken or deteriorated under a temperature that the members cannot resist, which is increased as a result of a temperature rise in both the end portions in which heat is not removed by a paper sheet. Further, even when a maximum-sized paper sheet is passed immediately after small-sized paper sheets are passed continuously, since a temperature of the fixing belt 36 always is kept uniform over the maximum-sized paper passing area $P_{A3L}$, hot offset can be prevented from occurring.

In this embodiment, switching of the switching unit 40 is performed after the passing of paper is started. That is, when starting to energize the excitation coil 3 and during standby, all the switching units 40 are in the unconnected state. According to this configuration, when starting energization and during standby, the fixing belt 36 is heated uniformly over the full width. Then, after the passing of paper is started, the switching units 40 are switched over so as to correspond to a paper width. Thus, a temperature rise in the end portions is suppressed, and even after passing of paper is started, a uniform temperature is attained over the full width.

Alternatively, a uniform temperature of the fixing belt 36 also can be attained by the following configuration. That is, when starting to energize the excitation coil 3 and during standby, all the switching units 40 are brought to the unconnected state, and after a temperature of the fixing belt 36 is increased to a set temperature, the switching units 40 are switched over.

Moreover, in this embodiment, the respective dimensions in the rotation axis direction of the heat generating roller 1 in ascending order are: a maximum paper width, a distance between the outermost ends of both the outermost U-shaped cores 6 (U-shaped cores 6*c*), a distance between the outermost ends of the excitation coil 3, a width of the fixing belt 36, a width of the heat insulating member 9, and a length of the heat generating roller 1. The width of the heat insulating member 9 is greater than the width of the excitation coil 3 and the distance between the outermost ends of both the outermost U-shaped cores 6. Accordingly, the rear core 4 is opposed to the heat generating roller 1 and the fixing belt 36 through the heat insulating member 9, and thus even when the rear core 4 is arranged closer to the heat generating roller 1, a temperature rise of the rear core 4 can be prevented. Further, the fixing belt 36 can be prevented from being cooled by cool airflow coming into contact with the fixing belt 36.

Furthermore, as shown in FIG. 9, the coil cover 33 is provided, and thus magnetic flux slightly leaking to a rear side of the rear core 4 and a high-frequency electromagnetic wave generated from the excitation coil 3 can be prevented from being propagated inside and outside the apparatus. Thus, electric circuits inside and outside the apparatus can be prevented from malfunctioning due to electromagnetic noise.

Moreover, airflow generated by the cooling fan 32 flows through a space surrounded by the coil cover 33 and the heat insulating member 9 as an air passage. Thus, while the heat generating roller 1 and the fixing belt 36 are not cooled by the airflow, the excitation coil 3 and the rear core 4 can be cooled.

Furthermore, magnetic members constituting the bottom plate 29, the top plate 30, and the body chassis 31 of the main body of the apparatus are arranged at a distance of not less than 20 mm from the excitation coil 3. Thus, magnetic flux passing through an inner portion of the rear core 4 can be prevented from being incident on the magnetic members including the chassis 31 and the like after being radiated from portions other than the opposing portions F and the opposing portions N to an outer side. Hence, electromagnetic energy supplied to the excitation coil 3 can be supplied to the heat generating roller 1 efficiently without heating the members constituting the apparatus uselessly. In this configuration, the distances between the excitation coil 3 and the structural members that are composed of the magnetic members including the chassis 31 constituting the main body of the apparatus were 20 mm, respectively. When the respective distances between the rear core 4 and these strength members are greater than a distance between the rear core 4 in the opposing portions F and N and the heat generating roller 1, and desirably, at least 1.5 times greater than the distance, magnetic flux can be prevented from leaking to an outer side of the rear core 4. In this embodiment, the fixing guide 25 and the paper ejecting guide 27 are formed from resin, which inevitably need to be arranged closest to the thermal fixing device 26, thereby making it easy to secure large distances between the rear core 4 and other magnetic members.

Furthermore, while the heat generating roller 1 is provided in an inner side of the fixing belt 36, the excitation coil 3, the rear core 4, and the additional coils 7 are provided at an outer side of the fixing belt 36. Therefore, temperatures of the excitation coil 3 and the like on the outer side hardly are increased by receiving heat from the heat generating portion. Thus, an amount of heat generated by the heat generating roller 1 can be kept stable, and an amount of generated heat can be prevented from being changed due to an excessive temperature rise of the rear core 4 and the like.

Furthermore, the excitation coil 3 having a cross-sectional area larger than that of the heat generating roller 1 can be used, and thus with respect to the heat generating roller 1 having small thermal capacity, the excitation coil 3 of many turns and the rear core 4 of a proper amount of ferrite can be used in combination. Therefore, while the thermal capacity of the thermal fixing device is suppressed, large power can be supplied using a predetermined electric current. Thus, a thermal fixing device can be realized, which achieves reduction in the manufacturing cost of the excitation circuit 10 and shortening of temperature raising time. In this embodiment, when an alternating current from the excitation circuit 10 has a RMS value of a voltage of 140 V (a voltage amplitude of 500 V) and a RMS value of a current of 22 A (a peak current of 55 A), a power level of 850 W can be attained.

Furthermore, the excitation coil 3 on the outer side causes a surface of the heat generating roller 1 to generate heat, and thus the fixing belt 36 being in contact with the surface is in contact with a portion in which an amount of heat generated is greatest in the heat generating roller 1. Therefore, the portion in which the greatest amount of heat is generated serves as a heat transmitting portion that transmits heat to the fixing belt 36, and thus the generated heat can be transmitted to the fixing belt 36 in such a manner as to reduce an amount of the heat conducted to an inner portion of the heat generating roller 1. The heat is transmitted in a small distance, and thus controlling that achieves a quick response to a change in a temperature of the fixing belt 36 can be performed.

Furthermore, the temperature sensor 11 is provided in the vicinity of a position on an extension of a contacting portion in which the fixing belt 36 is in contact with the heat generating roller 1. A temperature of this portion in which the temperature sensor 11 is provided is controlled so as to be constant, thereby allowing a temperature of the fixing belt 36 entering the nip portion to be constant all the time. Thus, regardless of the number of paper sheets that are passed continuously, stable fixing can be attained Moreover, the excitation coil 3 and the rear core 4 cover almost half an area of the cylindrical face of the heat generating roller 1, and thus almost the entire region of the contacting portion in which the fixing belt 36 is in contact with the heat generating roller 1 generates heat. Thus, an increased amount of heating energy transmitted from the excitation coil 3 to the heat generating roller 1 by electromagnetic induction can be transmitted to the fixing belt 36.

Furthermore, in the configuration of this embodiment, a material, thickness, or the like of each of the heat generating roller 1 and the fixing belt 36 can be set independently. Therefore, the material and thickness of the heat generating roller 1 can be selected optimally for performing heating by electromagnetic induction of the excitation coil 3. Further, the material and thickness of the fixing belt 36 can be set optimally for performing fixing.

In this embodiment, for attaining reduction in warm up time, the fixing belt 36 is set to have minimum thermal capacity, and the heat generating roller 1 is set to have minimum thermal capacity by reducing the thickness and outer diameter of the heat generating roller 1. Therefore, when all the switching units 40 are in the unconnected state, using a supplied power of 850 W, a fixing set temperature of 190 degrees centigrade can be attained within a period of about 18 seconds after starting to raise temperature for fixing. Further, when all the switching units 40 are in the connected state, with the excitation circuit 10 set in the same manner as in the above case, using a supplied power of 820 W, the fixing set temperature of 190 degrees centigrade can be attained within a period of about 15 seconds after starting to raise temperature. The heat generation suppressing units 8, each composed of the additional coil 7 and the switching unit 40, are provided, and the switching unit 40 is switched over so as to correspond to a paper width. In this manner, an area whose temperature is to be raised is reduced, and power is injected so as to be concentrated at the area. Thus, power consumption and a warm up time can be reduced as described above. In summary, when starting to energize the excitation coil 3, the switching units 40 are switched over so as to correspond to a width of a paper sheet to be passed, and thus temperature raising time and power consumption can be reduced.

Furthermore, in this embodiment, the base material of the fixing belt 36 was formed from resin. However, when a conductive ferromagnetic metal such as nickel is used in place of resin, heat generated by electromagnetic induction is generated partly in this fixing belt 36. In this case, the fixing belt 36 itself also can be heated, and thus heating energy can be transmitted to the fixing belt 36 more effectively.

Furthermore, the bottom plate 29, the top plate 30, and the chassis 31 of the main body of the apparatus were formed of magnetic materials. However, these members can be formed of resin materials. In this case, since the structural members of the apparatus do not affect lines of magnetic force, these members can be arranged in the vicinity of the rear core 4. Thus, the whole apparatus can be reduced in size.

In this embodiment, as shown in FIG. 14, the additional coil 7 suppresses the annular magnetic flux M generated by the excitation coil 3 in an area (a length L2) in which the additional coil 7 is provided. Therefore, the greater the length L2 of the area in which the additional coil 7 is provided in a direction along the path of the magnetic flux M, the more the heat generation suppressing effect is enhanced when the switching unit 40 is in the connected state. In this embodiment, the additional coil 7 of 1.5 turns is wound around the U-shaped core 6. Therefore, the length L2 of the area in which the additional coil 7 is provided in the direction along the magnetic flux M linking to the additional coil (conductor) 7 is greater than a thickness (this equals to a thickness of the wire constituting the coil) of the additional coil 7 in a plane perpendicular to the direction along the magnetic flux M. Thus, while the additional coil 7 is reduced in size and an amount of the material also is reduced, the heat generation suppressing effect of the additional coil 7 can be secured sufficiently.

Figure 16:
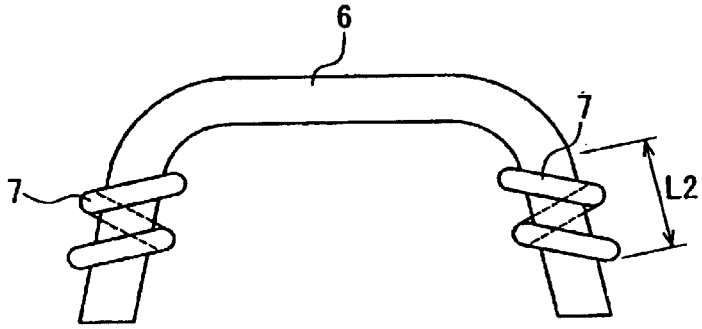
FIG. 16 is a schematic diagram showing another example of a configuration of an additional coil constituting the heat generation suppressing unit in the image heating device according to Embodiment 2 of the present invention.

As shown in FIG. 16, the additional coil 7 of the same number of turns may be wound so that the respective turns of the wire bundle constituting the additional coil 7 are at a distance from each other. According to this configuration, compared with a case where the wire bundle is wound tightly, the length L2 of the area in which the additional coil 7 is provided can be increased using a smaller amount of wire. Thus, the heat generation suppressing effect of the additional coil 7 can be enhanced sufficiently.

In this embodiment, the additional coil 7 is wound around the U-shaped core 6. Therefore, magnetic permeability of a space in a center of the additional coil 7 is increased. Thus, magnetic coupling acting from the excitation coil 3 to the additional coil 7 is enhanced, thereby allowing the heat generation suppressing effect to be enhanced sufficiently, which is provided by an electric current induced in the additional coil 7.

In this embodiment, a copper wire was used as a material of the additional coil 7. Generally, it is desirable that a material of the additional coil 7 has a low electric resistance value. Specifically, with an electric conductivity of not less than $1\times10^7$ [S/m], heat generation can be prevented from occurring under an induced electric current, and a large induction current is obtained, thereby allowing the heat generation suppressing effect to be attained sufficiently.

The additional coil 7 suppresses passing of the magnetic flux M through the U-shaped core 6 in the area of the length L2 in FIG. 14. More specifically, when the switching unit 40 is in the connected state, the magnetic flux M attempts to leak to a side of the heat generating roller 1 from the U-shaped core 6 immediately before reaching the additional coil 7. The magnetic flux that has leaked passes through a portion in which the U-shaped core 6 other than the opposing portion F and the opposing portion N is spaced at a long distance from the heat generating roller 1, and thus magnetic coupling between the U-shaped core 6 and the heat generating roller 1 is weakened. Further, an area in which the magnetic flux M passes through the heat generating roller 1 is decreased. As a result, heat generation of the heat generating roller 1 is suppressed. Therefore, when the additional coil 7 is provided in an end portion of the U-shaped core 6, the magnetic flux M can pass through the U-shaped core 6 in the vicinity of the end portion, thereby decreasing the heat generation suppressing effect provided by the additional coil 7. Conversely, the greater a distance from the end portion of the U-shaped coil 6 to the additional coil 7, the greater the difference between distances in which the magnetic flux M passes through the U-shaped core 6 when the switching unit 40 is in the connected state and when the switching unit 40 is in the unconnected state. Thus, the heat generation suppressing effect provided by the additional coil 7 becomes considerable. In this embodiment, a distance L1 from the end portion of the U-shaped core 6 to an end of the additional coil 7 on a side of the end portion of the U-shaped core 6 in the direction along the magnetic flux M is greater than the length L2 of the area in which the additional coil 7 is provided. Thus, a magnetic circuit is changed due to the switching of the switching unit 40 connected to the additional coil 7 to a greater degree, thereby allowing the heat generation suppressing effect provided by the additional coil 7 to be enhanced.

When the switching unit 40 connected to the additional coil 7 is switched over while a high-frequency current is applied to the excitation coil 3, in some cases, unwanted electromagnetic noise is caused, and an operation of the switching unit 40 is impaired. This is attributable to a switching operation performed when the additional coil 7 has a large current and voltage induced due to a change in the magnetic flux M generated under the high-frequency current applied to the excitation coil 3.

Particularly, when the switching unit 40 is in the connected state, a high-frequency current applied to the excitation coil 3 causes a high-frequency current of substantially the same waveform to be generated in the additional coils 7. When the switching unit 40 is switched off in a state where the current induced in the additional coil 7 is large, a steep abrupt change is caused, in which the current of the additional coil 7 abruptly falls to zero. Thus, an excessively large voltage is generated in the switching unit 40 that switches off the additional coil 7, thereby causing sparking and insulation destruction.

Even when the switching unit 40 is in the unconnected state, a voltage is generated at both ends of the additional coil 7, which is induced due to a change in the magnetic flux M generated under a high-frequency current applied to the excitation coil 3. The induced voltage has substantially the same waveform as that of a high-frequency voltage applied to the excitation coil 3. When the switching unit 40 is switched on in a state where the induced voltage is large, at the moment of the switching on, sparking and insulation destruction are caused, and a large electric current is caused to flow.

In order to solve the aforementioned problems, in this embodiment, when performing the switching operation of the switching unit 40, the supply of a high-frequency current to the excitation coil 3 is interrupted. This can prevent generation of an excessively high voltage in the switching unit 40 switching the additional coil 7 between the connected state and the unconnected state, and occurrence of sparking and insulation destruction. At the same time, abrupt changes in an electric current and a voltage in the additional coil 7 are prevented from being caused due to switching of the switching unit 40, thereby allowing the generation of unwanted electromagnetic noise also to be prevented.

In this embodiment, as the additional coil 7, the wire bundle composed of 20 wires is used. Since the electric resistance with respect to a high-frequency alternating current generated in the additional coil 7 is low, a large induction current can be obtained, and thus a highly effective supporting action upon the magnetic flux M can be attained.

Furthermore, in this embodiment, the additional coil 7 of two turns is wound around the U-shaped core 6. The second turn of the additional coil 7 is drawn out so as to be connected to the switching unit 40, and therefore, the number of the turns that is effective to form a magnetic circuit is 1 to 1.5. By increasing the number of the turns, the suppressing action upon the magnetic flux M generated by the excitation coil 3 further can be enhanced. Thus, by changing the number of turns depending on the degree of temperature ununiformity of the heat generating roller 1 in the rotation axis direction, temperature uniformity of the heat generating roller 1 in the rotation axis direction can be regulated.

In this embodiment, as the additional coil 7, the wire bundle of 20 wires having an outer diameter of 0.1 mm was used. By controlling the number of the wires constituting the wire bundle, the suppressing action upon the magnetic flux M that is performed by the additional coil 7 also can be controlled. Further, in this embodiment, the wire bundle composed of wires was used. However, by using a single wire (for example, a copper wire with its surface insulated having an outer diameter of 0.5 mm) and increasing the number of turns of the wire, the same action can be attained.

The U-shaped cores 6 of the rear core 4 may be provided obliquely with respect to the rotation axis of the heat generating roller 1. In this case, the opposing portions F at both ends of the U-shaped core 6 are arranged in different positions from each other in the rotation axis direction. Therefore, the areas at which magnetic flux is concentrated are dispersed in the rotation axis direction, and thus variations in heat generation of the heat generating roller 1 in the rotation axis direction can be suppressed.

Embodiment 3

Figure 17:
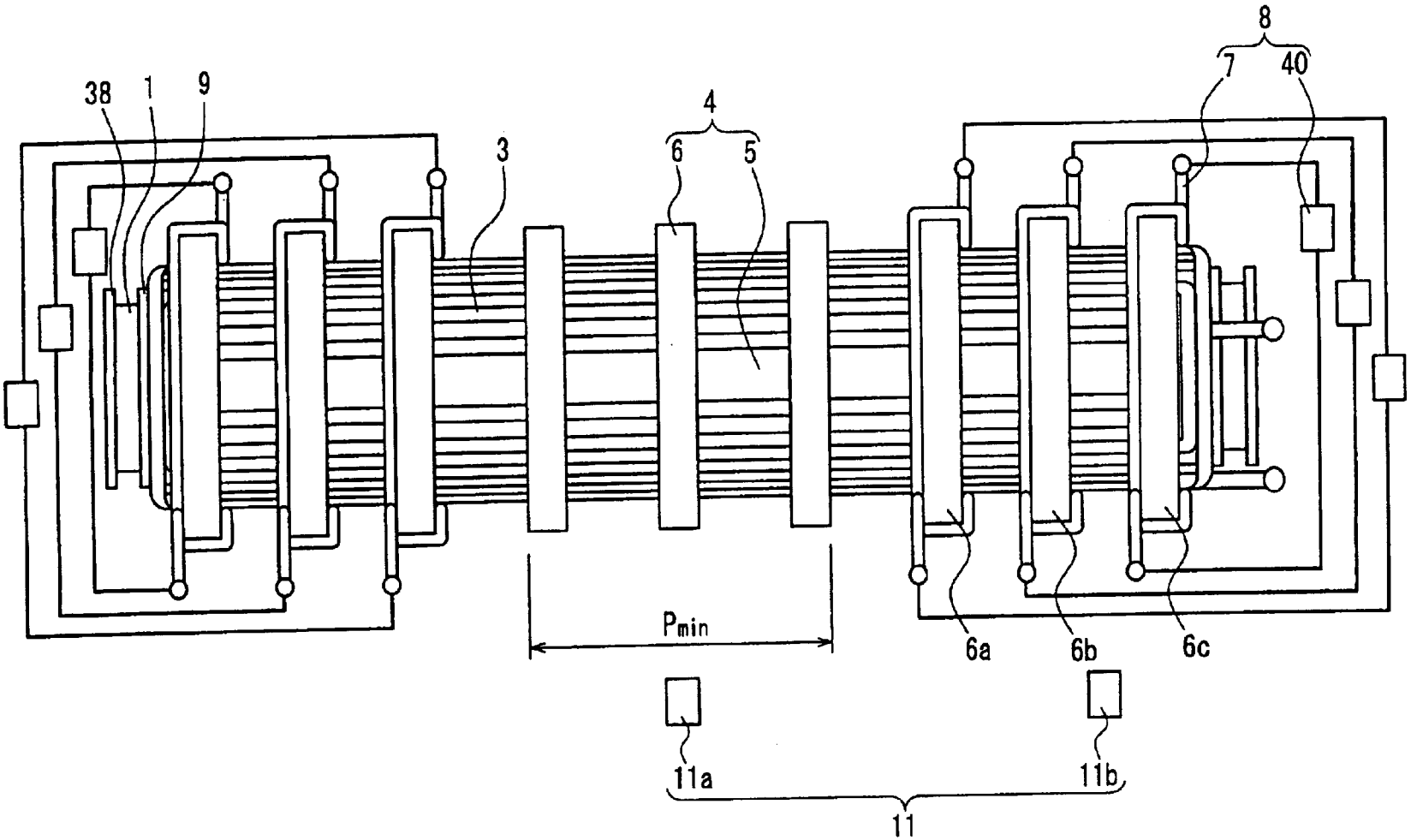
FIG. 17 is a diagram showing a configuration of a heat generating portion of an image heating device according to Embodiment 3 of the present invention.

FIG. 17 shows a configuration of a heat generating portion of an image heating device according to Embodiment 3 of the present invention. In the figure, like reference characters indicate like members having the same functions as those described with regard to Embodiment 2, for which duplicate descriptions are omitted.

In this embodiment, unlike the case of Embodiment 2, a pair of additional coils 7 provided on the same U-shaped core 6 are connected in series, and a switching unit 40 further is connected in series to the pair of the additional coils 7. Further, two temperature sensors 11*a* and 11*b* are provided within a minimum-sized paper passing area $P_{min}$ and outside the passing area $P_{min}$, respectively, so that a temperature of the fixing belt 36 is detected by each of the temperature sensors 11*a* and 11*b*. Based on temperature signals of both the temperature sensors 11*a* and 11*b*, which are obtained when a paper sheet is passed, the switching unit 40 is switched over so as to regulate a magnetic flux M, thereby regulating an amount of heat to be generated. Except for the above feature, the device is configured in the same manner as in Embodiment 2.

In Embodiment 2, two additional coils 7 were provided with respect to two magnetic fluxes M generated in the same U-shaped core 6, and two switching units 40 were connected so as to correspond to each of the additional coils 7, respectively, so that two closed circuits were formed. Then, using the magnetic fluxes P generated under two loop-shaped induction currents generated in the respective closed circuits, two magnetic fluxes M generated by an excitation coil 3 were suppressed separately.

In contrast to this, in this embodiment, two additional coils 7 provided in the same U-shaped core 6 and one switching unit 40 constitute one closed circuit. Then, using the magnetic flux P generated under one loop-shaped induction current generated in the one closed circuit, two magnetic fluxes M generated by the excitation coil 3 are suppressed. In this embodiment, with respect to Embodiment 2, a slight difference is caused in an induction current generated in the additional coils 7. However, by changing the number of a wire bundle constituting the additional coil 7 and the number of turns, the same heat generation suppressing action as that in Embodiment 2 can be attained.

According to a configuration of this embodiment, providing one switching unit with respect to one U-shaped core 6 is sufficient, in contrast to Embodiment 2 in which two switching units were required. Thus, the device can be of a simple configuration and reduced in manufacturing cost.

As described above, in this embodiment, the additional coils 7 provided, respectively, with respect to a plurality of the annular magnetic fluxes M generated by the excitation coil 3 are connected in series to one switching unit, and thus the plurality of the magnetic fluxes M generated in different positions can be controlled by using the single switching unit 40. Thus, using a smaller number of the switching units 40, a controlling operation can be performed more precisely, and a uniform temperature distribution can be realized.

In addition, a temperature of the fixing belt 36 is detected by a plurality of the temperature sensors 11*a* and 11*b* provided within the minimum-sized paper passing area and outside the minimum-sized passing area, respectively. Based on the temperature signals thus obtained, the switching unit 40 is switched over, thereby further enhancing the temperature uniformity of the fixing belt 36 in the rotation axis direction of the heat generating roller 1.

The number of the temperature sensors is not limited to two as in the above description and can be increased to three or more. For example, the heat generation suppressing units 8 and the temperature sensors may be provided so as to correspond to a size of a paper sheet to be passed. Thus, temperature variations further can be reduced, thereby allowing a uniform temperature to be attained.

When paper sheets to be passed vary little in size, the additional coils 7 provided on the adjacent U-shaped cores 6 further may be connected in series with one switching unit 40 connected in series thereto. According to this configuration, amounts of heat generated in areas corresponding to two (or three or more) U-shaped cores 6 can be controlled by switching of one switching unit 40, and thus the device can be of a further simplified configuration and manufactured at lower cost.

In this embodiment, the timing for a switching operation of the switching unit 40 is synchronized with a change in a high-frequency current (or a high-frequency voltage) supplied to the excitation coil 3 from a voltage resonant inverter of an excitation circuit 10 for the following reason. That is, when a switching operation of the switching unit 40 is performed in a state where an electric current (or a voltage) of the additional coil 7 is large, which is induced due to a change in the magnetic flux M generated under a high-frequency current (or a high-frequency voltage) supplied to the excitation coil 3, unwanted electromagnetic noise is caused, and an operation of the switching unit 40 is impaired, which are disadvantageous.

Particularly, when the switching unit 40 is in a connected state, a high-frequency current applied to the excitation coil 3 causes a high-frequency current of substantially the same waveform to be generated in the additional coils 7. When the switching unit 40 is switched off in a state where the electric current induced in the additional coil 7 is large, a steep change is caused, in which the electric current of the additional coil 7 abruptly falls to zero. Because of this, an excessively high voltage is generated in the switching unit 40 that switches off the additional coil 7, thereby causing sparking and insulation destruction.

When the switching unit 40 is in an unconnected state, a voltage induced due to a change in the magnetic flux M generated under a high-frequency current applied to the excitation coil 3 is generated at both ends of the additional coil 7. The induced voltage has substantially the same waveform as that of the high-frequency voltage applied to the excitation coil 3. When the switching unit 40 is switched on in a state where the induced voltage is large, at the moment of the switching on, sparking or insulation destruction is caused, and a large electric current is caused to flow.

In order to solve the aforementioned problems, in this embodiment, the timing for the switching operation of the switching unit 40 is synchronized with a change in a high-frequency current supplied to the excitation coil 3 from the voltage resonant inverter of the excitation circuit 10. Thus, at the moment when the electric current or voltage of the same waveform induced in the additional coil 7 under the high-frequency current supplied to the excitation coil 3 has a value of substantially zero, the switching operation of the switching unit 40 can be performed. This can prevent the generation of an excessively high voltage in the switching unit 40 switching the additional coil 7 between the connected state and unconnected state, and the occurrence of sparking and insulation destruction. At the same time, abrupt changes in an electric current and a voltage in the additional coil 7 are prevented from being caused due to a switching of the switching unit 40, thereby allowing generation of unwanted electromagnetic noise to be prevented.

The timing for the switching operation of the switching unit 40 can be synchronized with a change in a high-frequency current supplied to the excitation coil 3 in such a manner that switching of a switching element of the inverter of the excitation circuit 10 is timed with the switching operation of the switching unit 40. In this case, the switching operation of the switching unit 40 is not necessarily required to be timed completely with the switching and may be shifted for a predetermined time from the switching.

The switching operation of the switching unit 40 is not always performed once during one recording operation. The switching operation can be performed the number of times corresponding to a change in temperature during the recording operation. Further, the switching operation can be performed 10 to thousands of times per second. When performing the switching operation a number of times, unwanted electromagnetic noise is likely to be caused. Therefore, it is particularly important to synchronize the timing for the switching operation of the switching unit 40 with a change in a high-frequency current supplied to the excitation coil 3. In one recording operation, the switching operation of the switching unit 40 can be performed once to the number of times corresponding to a frequency of the high-frequency current.

Embodiment 4

Figure 18:
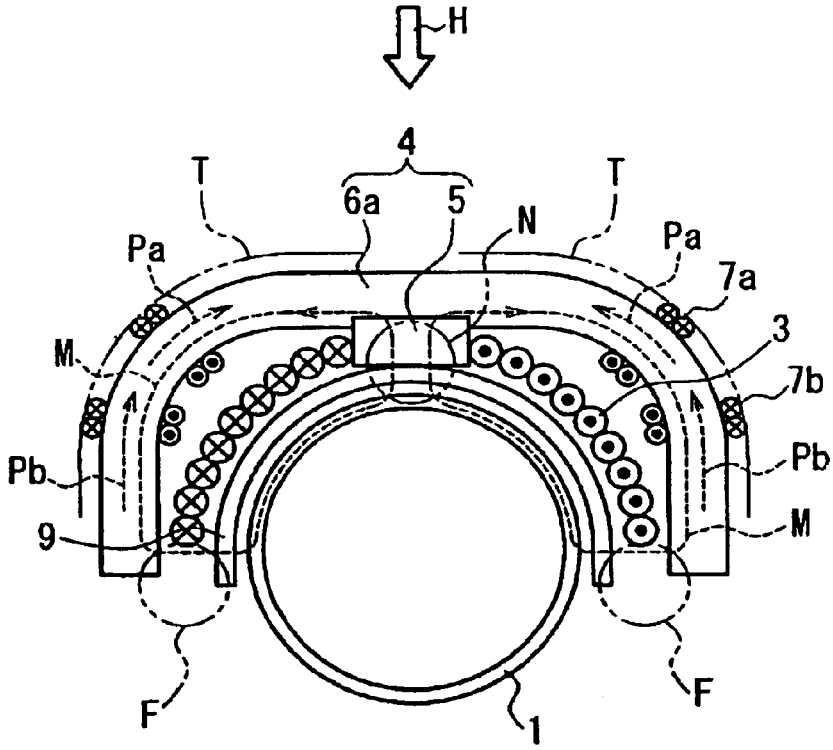
FIG. 18 is a cross-sectional view of a heat generating portion of an image heating device according to Embodiment 4 of the present invention.
Figure 19:
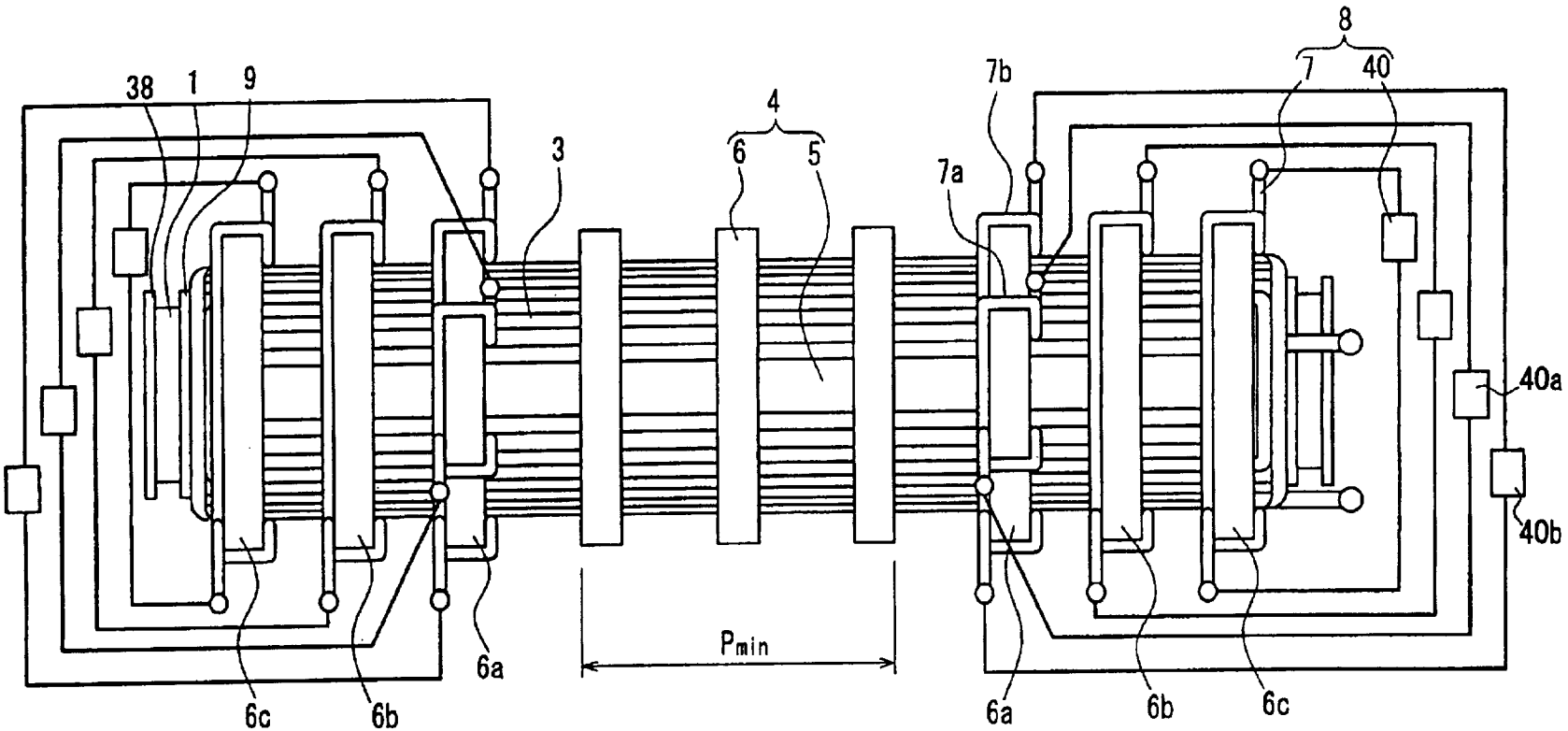
FIG. 19 is a diagram showing a configuration of the heat generating portion as seen from a direction indicated by an arrow H in FIG. 18.

FIG. 18 is a cross-sectional view of a heat generating portion of an image heating device according to Embodiment 4 of the present invention. FIG. 19 shows a configuration of the heat generating portion as seen from a direction indicated by an arrow H in FIG. 18. In the following description, like reference characters indicate like members having the same actions as those described with regard to Embodiment 3, on which duplicate descriptions are omitted.

In this embodiment, unlike the case of Embodiment 3, two pairs of heat generation suppressing units 8 are provided on the U-shaped core 6*a*.

An additional coil 7*a* is formed of a wire bundle composed of 25 wires of a copper wire with its surface insulated and having an outer diameter of 0.1 mm. The additional coils 7*a* of two turns are wound around magnetically permeable portions T on both sides of the U-shaped core 6*a*, respectively. The wires of each pair of the additional coils 7*a* are wound in opposite directions. The pair of the additional coils 7*a* are connected to each other in series, and a switching unit 40*a* further is connected in series thereto.

An additional coil 7*b* is the same as the additional coil 7 described with regard to Embodiment 3. A pair of the additional coils 7*b* are connected to each other in series, and a switching unit 40*b* further is connected in series thereto.

A heat generation suppressing unit 8 provided on each of the U-shaped cores 6*b* and 6*c* is the same as that described with regard to Embodiment 3.

According to this configuration, with respect to a magnetic flux passing through the U-shaped core 6*a*, switching can be performed among four states as follows.

In a first state, a switching unit 40*a* connected to the additional coils 7*a* is brought to a connected state, and the switching unit 40*b* connected to the additional coils 7*b* also is brought to the connected state. In FIG. 18, a magnetic flux Pa (in an opposite direction to a direction of a magnetic flux M) is generated under an induction current generated in each of the additional coils 7*a*, and a magnetic flux Pb (in an opposite direction to a direction of the magnetic flux M) is generated under an induction current generated in each of the additional coils 7*b*. Both the magnetic fluxes are added to suppress the magnetic flux M generated by the excitation coil 3 to a great degree.

In a second state, the switching unit 40*a* connected to the additional coils 7*a* is bought to the connected state, and the switching unit 40*b* connected to the additional coils 7*b* is brought to an unconnected state. In this case, while the magnetic flux Pa is generated under an induction current generated in each of the additional coils 7*a*, an induction current is not generated in each of the additional coils 7*b*, and thus the magnetic flux Pb also is not generated. As a result, the magnetic flux M generated by the excitation coil 3 is suppressed by the magnetic flux Pa generated by the additional coil 7*a* alone. Thus, compared with the above first state in which both the switching units 40*a* and 40*b* are in the connected state, a suppressing action upon the magnetic flux M generated by the excitation coil 3 is limited.

In a third state, the switching unit 40*a* connected to the additional coils 7*a* is brought to the unconnected state, and the switching unit 40*b* connected to the additional coils 7*b* is brought to the connected state. In this case, while the magnetic flux Pb is generated under an induction current generated in each of the additional coils 7*b*, an induction current is not generated in each of the additional coils 7*a*, and thus the magnetic flux Pa also is not generated. As a result, the magnetic flux M generated by the excitation coil 3 is suppressed by the magnetic flux Pb generated by the additional coil 7*b* alone. The additional coil 7*a* is composed of a larger number of wires than the additional coil 7*b*. Accordingly, a larger induction voltage is generated by the additional coil 7*a*. Thus, the magnetic flux Pa generated in the above second state is larger than the magnetic flux Pb generated in this third state. Hence, the suppressing action upon the magnetic flux M generated by the excitation coil 3 is limited in this third state compared with the above second state.

In a fourth state, the switching unit 40*a* connected to the additional coils 7*a* is brought to the unconnected state, and the switching unit 40*b* connected to the additional coils 7*b* also is brought to the unconnected state. In this case, the magnetic fluxes Pa and Pb are not generated by both the additional coils 7*a* and 7*b*, and the magnetic fluxes M generated by the excitation coil 3 act in favor of heat generation.

As described above, switching can be performed among the following four states: a state in which the magnetic fluxes M generated by the excitation coil 3 are suppressed by the magnetic fluxes Pa and Pb generated by the additional coils 7*a* and 7*b* (first state); a state in which the magnetic fluxes M generated by the excitation coil 3 are suppressed by either of the magnetic fluxes Pa and Pb generated by the additional coils 7*a* and 7*b* (second state, third state); and a state in which the magnetic fluxes M generated by the excitation coil 3 are not suppressed by the magnetic fluxes Pa and Pb generated by the additional coils 7*a* and 7*b* (fourth state).

According to this configuration, the temperature can be controlled even more precisely, thereby further improving the temperature uniformity of the fixing belt 36 in the rotation axis direction of the heat generating roller 1.

In the aforementioned example, two types of heat generation suppressing units having different configurations were provided on the U-shaped cores 6*a*. However, three or more types of heat generation suppressing units may be provided Further, the heat generation suppressing units of the same configuration may be provided on one U-shaped core. Further, in place of the U-shaped core 6*a*, or in addition to the U-shaped core 6*a*, the same heat generation suppressing units may be provided with respect to the other U-shaped cores 6*b* and 6*c*.

Embodiment 5

Figure 20:
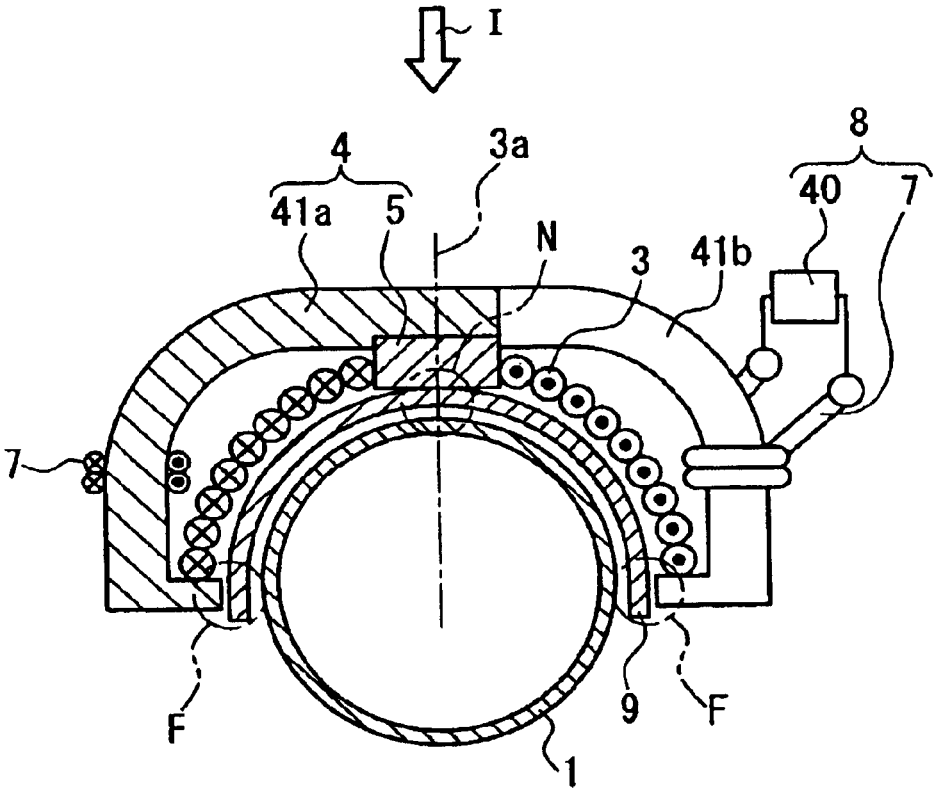
FIG. 20 is a cross-sectional view of a heat generating portion of an image heating device according to Embodiment 5 of the present invention.
Figure 21:
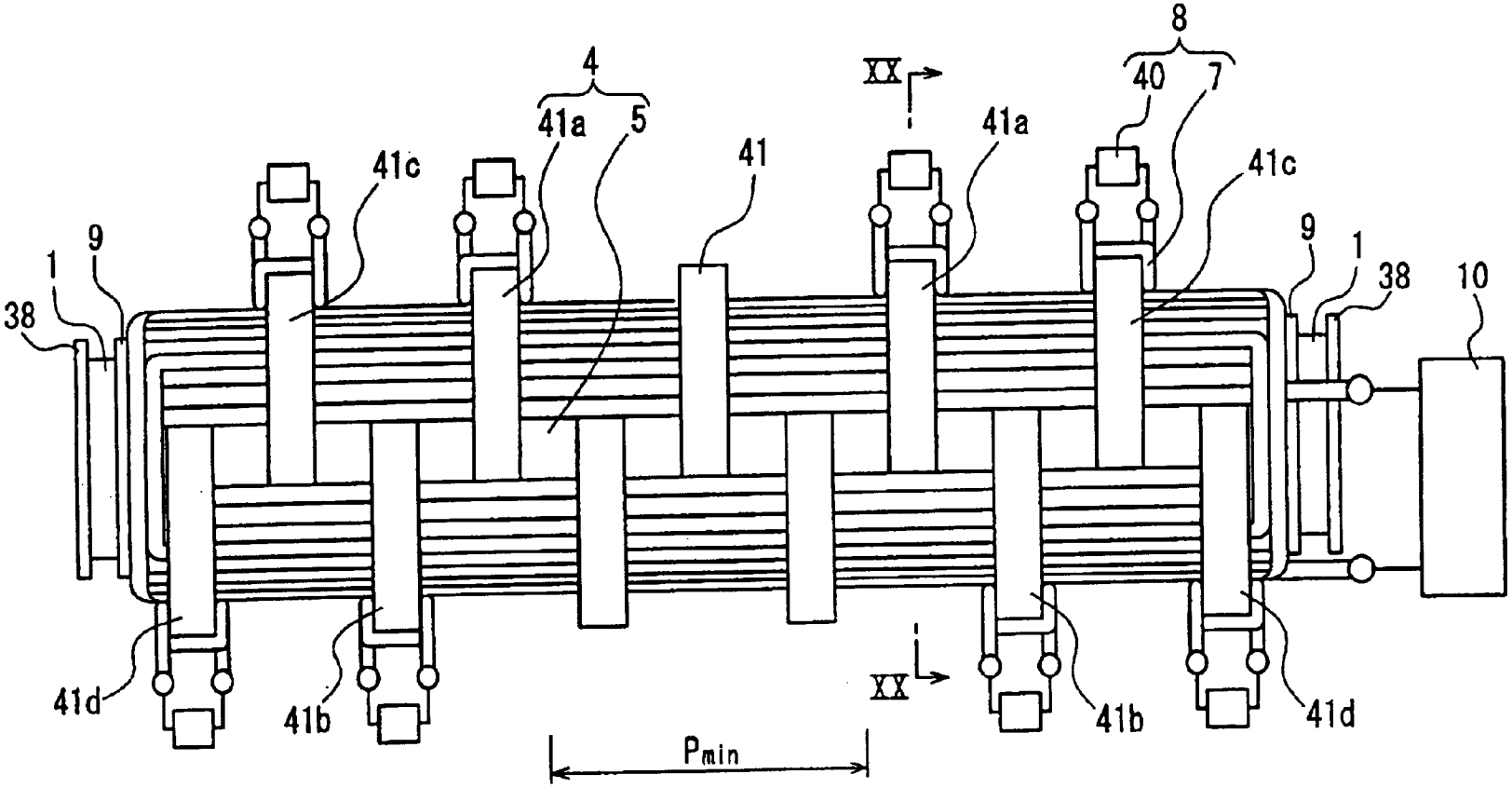
FIG. 21 is a diagram showing a configuration of the heat generating portion as seen from a direction indicated by an arrow I in FIG. 20.

FIG. 20 is a cross-sectional view of a heat generating portion of an image heating device according to Embodiment 5 of the present invention. FIG. 21 shows a configuration of the heat generating portion as seen from a direction indicated by an arrow I in FIG. 20. FIG. 20 is a cross-sectional view taken on line XX—XX of FIG. 21. In the following description, like reference characters indicate like members having the same functions as those described with regard to Embodiment 2, on which duplicate descriptions are omitted.

In this embodiment, in place of the U-shaped core 6 described with regard to Embodiment 2, a substantially L-shaped core 41 is used. The L-shaped core 41 is arranged so as to be opposed to an outer peripheral face of a heat generating roller 1. In the cross-sectional view shown in FIG. 20, the L-shaped core 41 is opposed to the outer peripheral face of the heat generating roller 1 in an area defined by an angle of about 90 degrees with respect to a rotation central axis of the heat generating roller 1.

As in Embodiment 2, also in this embodiment, a bar-like central core (second core portion) 5 is arranged so as to be opposed to the outer peripheral face of the heat generating roller 1, parallel to the rotation central axis of the heat generating roller 1.

One end portion of the L-shaped core 41 is connected magnetically to the central core 5. As shown in FIG. 21, which is a view as seen from a direction parallel to a winding central axis 3*a* of an excitation core 3, 11 L-shaped cores 41 are arranged at a distance from each other in a rotation axis direction of the heat generating roller 1. Each of the L-shaped cores 41 is provided alternately in opposite directions with respect to the central core 5, namely in a staggered arrangement.

In this embodiment, a maximum recording width is assumed to be the same as that in the case of Embodiment 2, and the heat generating roller 1 is of the same length as that in Embodiment 2. In Embodiment 2, with respect to the heat generating roller 1 of the same size, nine U-shaped cores 6 were arranged at an equal distance from each other in the rotation axis direction of the heat generating roller 1. In contrast to this, in this embodiment, 11 L-shaped cores 41 are arranged at an equal distance from each other in the direction Thus, in this embodiment, a distance between the adjacent L-shaped cores 41 is smaller than a distance between the adjacent U-shaped cores 6 in Embodiment 2.

An end of the L-shaped core 41 that is not connected to the central core 5 is extended to an area that is not opposed to the excitation coil 3 to form an opposing portion F opposed to the heat generating roller 1 without interposing the excitation coil 3 between them. In this embodiment, the end portion of the L-shaped core 41 forming the opposing portion F protrudes to a side of the heat generating roller 1 so that magnetic coupling is enhanced. Further, as in Embodiment 2, the central core 5 is opposed to the heat generating roller 1 without interposing the excitation coil 3 between them and protrudes further to the side of the heat generating roller 1 than the L-shaped core to form an opposing portion N. The opposing portion N of the protruding central core 5 is inserted into a hollow portion of a winding central of the excitation coil 3.

In this embodiment, as described above, each of a plurality of the L-shaped cores 41 is provided alternately in opposite directions with respect to the central core 5. Therefore, as shown in FIG. 21, unlike the case of Embodiment 2, as seen from a direction parallel to the winding central axis 3*a* of the excitation core 3, the opposing portions N are provided asymmetrically (namely, in a staggered arrangement) with respect to the central core 5.

Of the 11 L-shaped cores 41, the first to fourth L-shaped cores 41*a*, 41*b*, 41*c*, and 41*b* from both outer sides are provided with heat generation suppressing units 8, each composed of an additional coil 7 and a switching unit 40.

In Embodiment 2, two opposing portions F on both sides of each U-shaped cores 6 are positioned so as to coincide with each other in the rotation axis direction of the heat generating roller 1. Therefore, the trajectories of two opposing portions F at both ends of one U-shaped core 6 coincide with each other on an outer surface of the heat generating roller 1 being rotated. A surface portion of the heat generating roller 1, on which the trajectories are formed, is rotated in such a manner as to be opposed to two opposing portions F. A surface portion of the heat generating roller 1 in a different position from a position of the above surface portion in the rotation axis direction is rotated in such a manner as not to be opposed to the opposing portions F. This causes a difference between amounts of heat generated in both the positions, and thus variations in a temperature distribution in the rotation axis direction are likely to be caused.

In contrast to this, in this embodiment, the opposing portions N are provided in a staggered arrangement, and thus one portion on the surface of the heat generating roller 1 is rotated in such a manner as to be opposed to one opposing portion F. Accordingly, compared with the case of Embodiment 2, on the outer surface of the heat generating roller 1, a difference is not likely to be caused between amounts of heat generated in the portion opposed to the opposing portion N and the portion that is not opposed to the opposing portion N. Thus, variations in a temperature distribution in the rotation axis direction are not likely to be caused.

Furthermore, the L-shaped cores 41 are provided in a staggered arrangement with respect to the central core 5, and thus a heat radiation property is improved. Therefore, the L-shaped cores 41 easily can be designed so as to be arranged at a smaller distance from each other in the rotation axis direction of the heat generating roller 1. In this case, the opposing portions N also are arranged at a smaller distance from each other in the rotation axis direction of the heat generating roller 1, and thus variations in a temperature distribution further can be suppressed.

Moreover, the L-shaped core 41 has a volume as small as about one-half that of the U-shaped core 6. This allows a reduction in manufacturing cost and weight.

In addition, even when paper sheets varying in size are passed, an action of the heat generation suppressing unit 8 allows the heat generating roller 1 and a fixing belt 36 to be maintained at a uniform temperature with no variations.

Furthermore, in the opposing portion F, a convex portion protruding to a side of the heat generating roller 1 is provided, thereby further reducing a distance between the L-shaped core 41 and the heat generating roller 1. Accordingly, the magnetic flux from the excitation coil 3 is introduced thoroughly to the heat generating roller 1, and thus magnetic coupling between the heat generating roller 1 and the excitation coil 3 is enhanced. This embodiment is feasible also in the case where the excitation coil 3 and the rear core 4 are in contact or arranged at a distance of about 1 mm from each other. In the case of providing the distance between them, a temperature rise in a portion in which the excitation coil 3 and the rear core 4 are opposed to each other can be prevented.

Furthermore, the L-shaped core 41 is employed, which covers the heat generating roller 1 in the area defined by an angle of about 90 degrees in a rotation direction, thereby achieving reduction in weight and allowing heat radiation to be enhanced by an increase in surface area. Thus, the device can be reduced in size and weight, and at the same time, cost reduction can be attained.

Furthermore, when the device is configured so that airflow is passed between the heat insulating member 9 and the excitation coil 3, heat radiation of the excitation coil 3 further can be enhanced.

Moreover, in the above example, all the L-shaped cores 41 were of a uniform width in the rotation axis direction of the heat generating roller 1 and the same shape and arranged at an equal distance from each other in the rotation axis direction. However, the L-shaped cores 41 may be varied in width or arranged at a varying distance from each other. Alternatively, the opposing portion F opposed to the heat generating roller 1 may be formed continuously in the rotation axis direction. In each case, a uniform temperature with no variations further can be attained.

Embodiment 6

Figure 22:
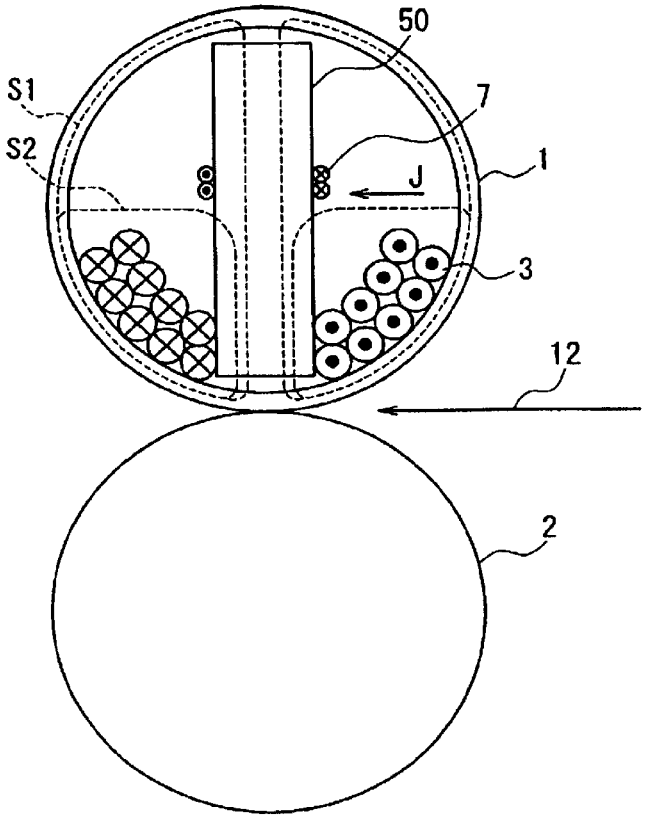
FIG. 22 is a cross-sectional view of an image heating device according to Embodiment 6 of the present invention.
Figure 23:
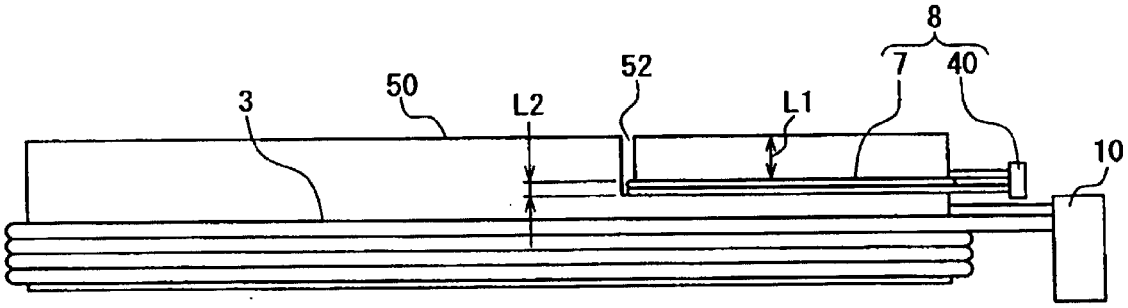
FIG. 23 is a side view of a core as seen from a direction indicated by an arrow J in FIG. 22.

FIG. 22 is a cross-sectional view of an image heating device according to Embodiment 6 of the present invention. FIG. 23 is a side view of a core as seen from a direction indicated by an arrow J in FIG. 22. In the figure, like reference characters indicate like members that are formed of the same materials and perform the same functions as those described with regard to Embodiment 2, for which duplicate descriptions are omitted.

In this embodiment, unlike the case of Embodiment 2, an excitation coil 3 is wound on an outer periphery of a core 50 of substantially a rectangular solid, and the core 50 with the excitation coil 3 is provided in an inner portion of a cylindrical heat generating roller 1 formed of a conductive material. As shown in FIG. 22, the core 50 has a height slightly smaller than an inner diameter of the heat generating roller 1. Further, in FIG. 23, the core 50 has a dimension in a lateral direction (length in a longitudinal direction) that substantially corresponds to a length of the heat generating roller 1. In this embodiment, when passing paper sheets varying in size, passing always is performed relative to a left end of FIG. 23. Thus, when passing a paper sheet of a small width, a non-paper passing region is formed only on a right side of FIG. 23.

At a right end of the core 50 shown in FIG. 23, a heat generation suppressing unit 8 composed of an additional coil 7 and a switching unit 40 is provided so as to correspond to the non-paper passing region. In a position substantially corresponding to an end portion of a passing region of a small-sized paper sheet, a slit 52 is formed downwardly, and the additional coil 7 is wound between the slit 52 and a right end face of the core 50. The additional coil 7 is wound closely to the core 50 from the right end face. The additional coil 7 includes a full turn and another substantially full turn, and both ends of the additional coil 7 are drawn out to the right end portion. The end portions that have been drawn out are connected to the switching unit 40.

Hereinafter, an action of the additional coil 7 will be described with reference to FIG. 22.

When the switching unit 40 for switching the additional coil 7 between a connected state and an unconnected state is in the unconnected state, annular magnetic fluxes S1 are formed by the excitation coil 3, which penetrate the core 50 in a vertical direction, enter the heat generating roller 1 from top and bottom end faces, and pass through the heat generating roller 1 in a peripheral direction. The magnetic fluxes S1 described above are formed over the full width in the longitudinal direction of the core 50. The magnetic fluxes S1 are generated and disappear repeatedly under an alternating current of an excitation circuit 10. As a result, the heat generating roller 1 generates heat over the full width in the rotation axis direction.

When the switching unit 40 for switching the additional coil 7 between the connected state and the unconnected state is in the connected state, in the additional coil 7 wound in a path of the magnetic fluxes S1, an induced electromotive force is generated due to a change in each of the magnetic fluxes S1. Under the induced electromotive force, a loop-shaped induction current linking to the magnetic flux S1 is generated in the additional coil 7, and thus magnetic fluxes (not shown) in opposite directions to those of the magnetic fluxes S1 are generated in the core 50. The magnetic fluxes in the opposite directions suppress the passing of the magnetic fluxes S1 through an inner portion of the additional coil 7. Therefore, as shown by dashed lines S2, paths are formed, which enter the heat generating roller 1 from immediately before reaching the additional coil 7 of the core 50 via the air. Due to low magnetic permeability of the air, magnetic coupling between the excitation coil 3 and the heat generating roller 1 is weakened. Moreover, resulting also from an area through which the magnetic fluxes pass in the heat generating roller 1 becoming smaller, an amount of heat generated in a region in which the additional coil 7 is provided is suppressed.

When the switching unit 40 is in the connected state, a high-frequency current applied to the excitation coil 3 causes a high-frequency current of substantially the same waveform to be generated in the additional coil 7. When the switching unit 40 is switched off in a state where an electric current induced in the additional coil 7 is large, a steep change is caused, in which the electric current of the additional coil abruptly falls to zero. Because of this, an excessively high voltage is generated in the switching unit 40 that switches off the additional coil 7, thereby causing sparking and insulation destruction.

Even when the switching unit 40 is in the unconnected state, a voltage is generated at both ends of the additional coil 7, which is induced due to a change in the magnetic fluxes S1 generated under a high-frequency current applied to the excitation coil 3. The induced voltage has substantially the same waveform as that of the high-frequency voltage applied to the excitation coil 3. When the switching unit 40 is switched on in a state where the induced voltage is large, at the moment of the switching on, sparking and insulation destruction are caused, and a large electric current is caused to flow.

In order to solve the aforementioned problems, in this embodiment, when an electric current induced in the additional coil 7 has a value of zero, the switching unit 40 is switched to the unconnected state. Further, when an electric voltage induced in the additional coil 7 has a value of zero, the switching unit 40 is switched to the connected stated. This can prevent the generation of an excessively high voltage in the switching unit 40 for switching the additional coil 7 between the connected state and the unconnected state and the occurrence of sparking and insulation destruction. At the same time, by preventing abrupt changes in an electric current and a voltage caused in the additional coil 7 due to switching of the switching unit 40, the generation of unwanted electromagnetic noise also can be prevented.

A switching operation of the switching unit 40 is not always performed once during one recording operation. The switching operation can be performed the number of times corresponding to a change in temperature during the recording operation. Further, the switching operation can be performed 10 to thousands of times per second. When performing the switching operation a number of times, unwanted electromagnetic noise is likely to be caused. Therefore, it is particularly important to synchronize the timing for the switching operation of the switching unit 40 with a change in a high-frequency current supplied to the excitation coil 3. In one recording operation, the switching operation of the switching unit 40 can be performed from once to the number of times corresponding to a frequency of the high-frequency current.

Furthermore, in this embodiment, the additional coil 7 includes substantially two turns, thereby allowing a considerable effect to be attained compared with the case where the additional coil 7 includes only one turn.

The additional coil 7 suppresses passing of the magnetic fluxes S1 through the core 50 in an area of a length L2 shown in FIG. 23. Therefore, when the additional coil 7 is provided in an upper end portion of the core 50, the magnetic fluxes S2 can pass to the vicinity of the upper end portion of the core 50. Accordingly, the magnetic fluxes S2 pass through the air in a shorter distance, and thus the heat generation suppressing effect provided by the additional coil 7 is reduced. Conversely, the greater a distance from the upper end portion to the additional coil 7, the greater the difference between distances in which the magnetic fluxes S2 pass through the core 50 when the switching unit 40 is in the connected state and when the switching unit 40 is in the unconnected state. Thus, the heat generation suppressing effect provided by the additional coil 7 becomes considerable. In this embodiment, a distance L1 from the upper end of the core 50 to an end of the additional coil 7 on a side of the upper end of the core 50 in a direction along the magnetic fluxes S1 is greater than the length L2 of the area in which the additional coil 7 is provided in the direction along the magnetic fluxes S1. Thus, a magnetic circuit is changed due to switching of the switching unit 40 connected to the additional coil 7 to a greater degree, thereby allowing the heat generation suppressing effect provided by the additional coil 7 to be enhanced.

In this embodiment, as shown in FIG. 23, the additional coil 7 suppresses the annular magnetic fluxes S2 generated by the excitation coil 3 in the area (length L2) in which the additional coil 7 is provided. Therefore, the greater the length L2 of the area in which the additional coil 7 is provided in the direction along the paths of the magnetic fluxes S1, the more the heat generation suppressing effect is enhanced when the switching unit 40 is in the connected state. In this embodiment, the additional coil 7 of substantially two turns is wound around the core 50. Therefore, the length L2 of the area in which the additional coil 7 is provided in the direction along the magnetic fluxes S1 linking to the additional coil (conductor) 7 is greater than a thickness (this is equivalent to a thickness of a wire constituting the coil) of the additional coil 7 in a plane perpendicular to the direction along the magnetic fluxes S1. Thus, while the additional coil 7 is reduced in size and formed of a reduced amount of a material, the heat generation suppressing effect of the additional coil 7 can be secured sufficiently.

The following configuration also can provide the effect of making a temperature distribution uniform. That is, a thin sheet metal is formed into a loop and wound around the core 50 so as to suppress an amount of heat generated in a region of the heat generating roller 1 corresponding to a portion in which the sheet metal is provided. The sheet metal has a thickness equivalent to an outer diameter of a wire constituting the additional coil 7 and a width equivalent to the length L2 of the area in which the additional coil 7 is provided.

Figure 24:
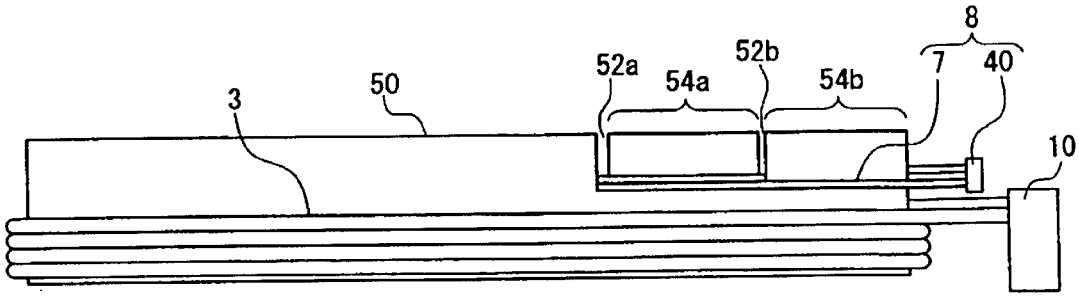
FIG. 24 is a side view showing another example of a configuration of an additional coil constituting a heat generation suppressing unit in the image heating device according to Embodiment 6 of the present invention.

In the aforementioned example, the respective substantially two turns of the additional coil 7 were wound on substantially the same path. However, the present invention is not limited thereto. For example, as shown in FIG. 24, two slots 52*a* and 52*b* are formed downwardly on the core 50, and the additional coil 7 is wound with one turn around a region 54*a* between the slots 52*a* and 52*b* and then is drawn out to a right end portion of the core 50. In this configuration, when the switching unit 40 is in the connected state, the magnetic fluxes S1 are suppressed by the additional coil 7 to a greater degree in the region 54*a* around which the additional coil of two turns is wound than in a region 54*b* on a side towards the right end portion, around which the additional coil of one turn is wound. Accordingly, heat generation can be suppressed to a greater degree in the region 54*a*. This configuration provides the following effect. When passing a small-sized paper sheet, it is necessary to suppress an amount of heat generated in non-paper passing regions of the heat generating roller 1 corresponding to the regions 54*a* and 54*b*. On the other hand, in end portions of the heat generating roller 1 in the rotation axis direction, the degree of heat radiation is high, and thus the temperature is likely to be lowered. In the above configuration, heat generation is suppressed to a lesser degree in the region 54*b* on an end side than in the region 54*a* on an inner side. Thus, while a temperature drop caused by heat radiation in the end portion is suppressed, heat generation in the regions in which paper sheets are not passed can be suppressed. As a result, a temperature distribution of the heat generating roller 1 in the rotation axis direction can be maintained uniformly.

Figure 25:
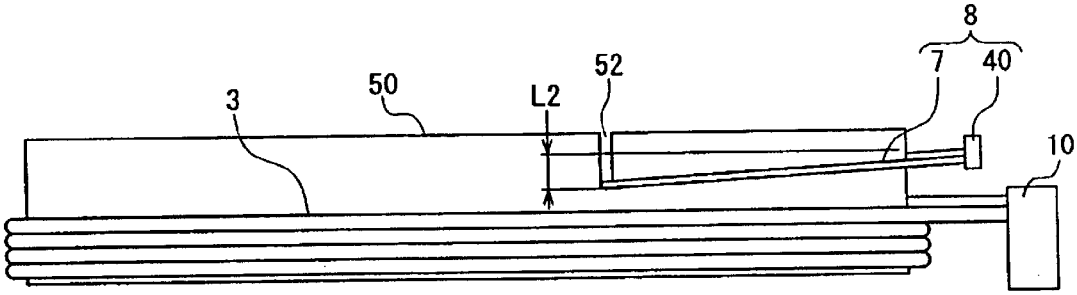
FIG. 25 is a side view showing still another example of the configuration of the additional coil constituting the heat generation suppressing unit in the image heating device according to Embodiment 6 of the present invention.

Furthermore, in the aforementioned example, the additional coil 7 was provided parallel to a longitudinal direction of the core 50. However, the present invention is not limited thereto. For example, as shown in FIG. 25, a configuration may be employed, in which the additional coil 7 of one turn is inclined so that a distance between the additional coil 7 and the excitation coil 3 is shorter on a side of the slot 52 and longer on a side of the right end portion of the core 50. In this example, a distance from the additional coil 7 to the upper end of the core 50 is 5 mm in the right end portion of the core 50 and 10 mm in a position of the slot 52. This configuration provides the following effect. That is, when the switching unit 40 is in the connected state, in a portion of the core 50 on an upper side of the additional coil 7, magnetic fluxes generated by the excitation coil 3 are not passed. By arranging the additional coil 7 diagonally with respect to paths of the magnetic fluxes as described above, each of the magnetic fluxes is passed through the core 50 in a distance that increases from the slot 52 toward the right end portion. Accordingly, the heat generation suppressing effect of the additional coil 7 becomes weaker in a direction from the slot 52 toward the right end portion. Thus, while a temperature drop is suppressed in the end portion in which a degree of heat radiation is high, an amount of heat generated in the regions in which no paper sheets are passed can be suppressed. As a result, a temperature distribution of the heat generating roller 1 in the rotation axis direction can be maintained uniformly. Needless to say, the effect of suppressing temperature variations also can be attained by using the additional coil 7 of an increased number of turns rather than the additional coil 7 of one turn used in the above case.

Figure 26:
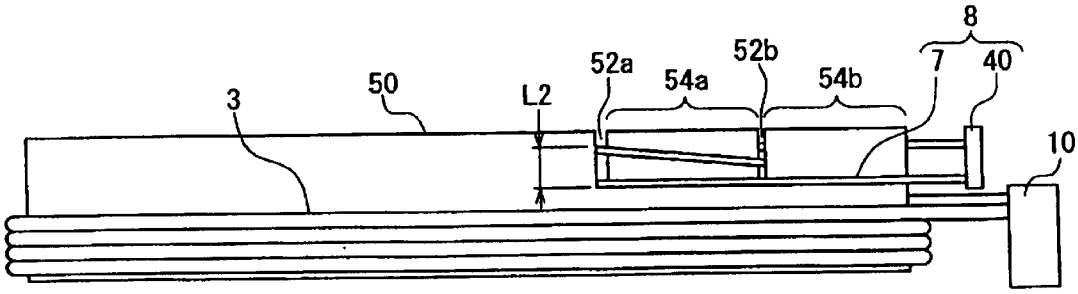
FIG. 26 is a side view showing still another example of the configuration of the additional coil constituting the heat generation suppressing unit in the image heating device according to Embodiment 6 of the present invention.
Figure 27:
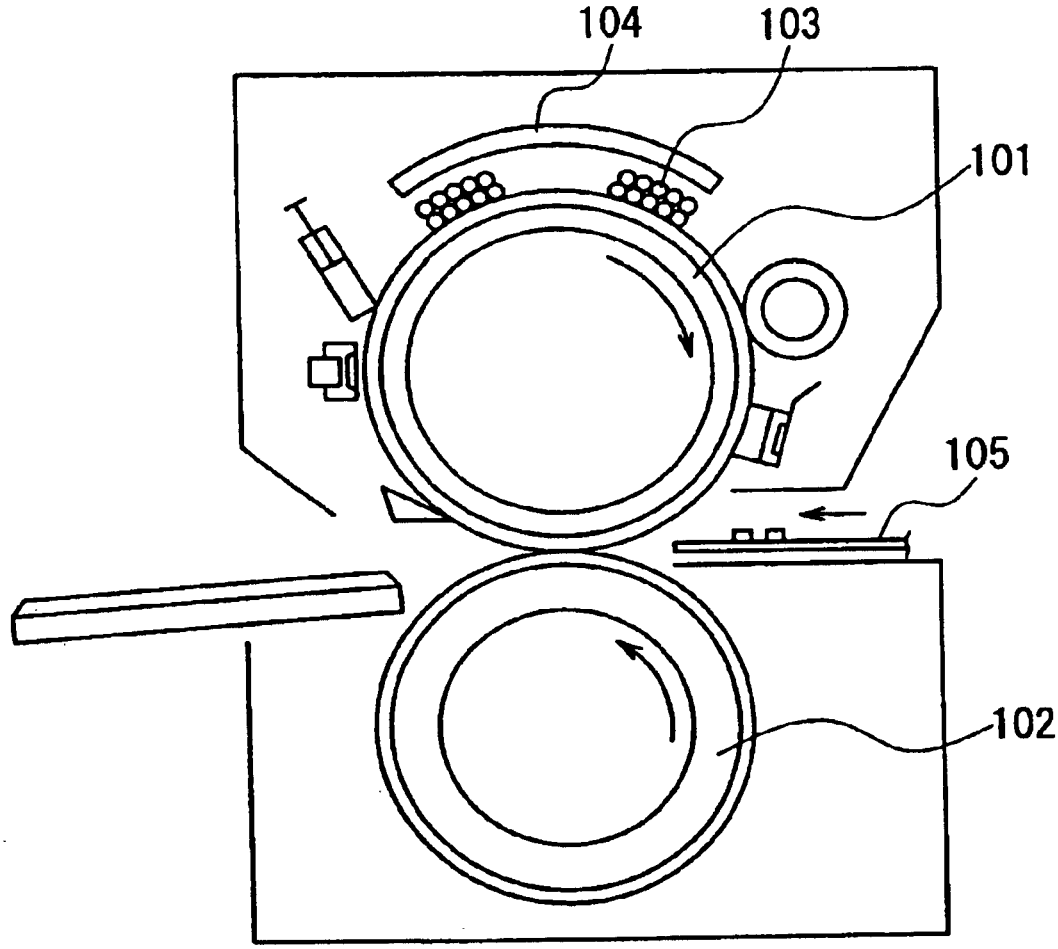
F I G. 27 PRIOR ART
FIG. 27 is a cross-sectional view of a conventional image heating device.
Figure 28:
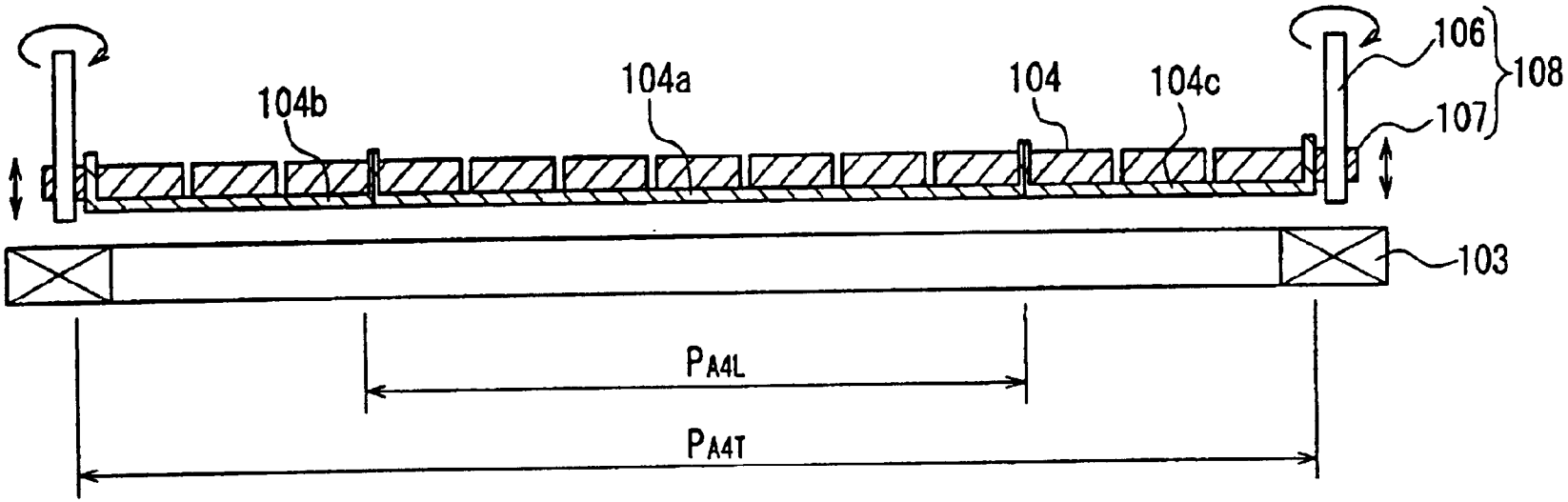
FIG. 28 PRIOR ART
FIG. 28 is a front view showing a moving mechanism of a fixing device used in the image heating device shown in FIG. 27.
Figure 29:
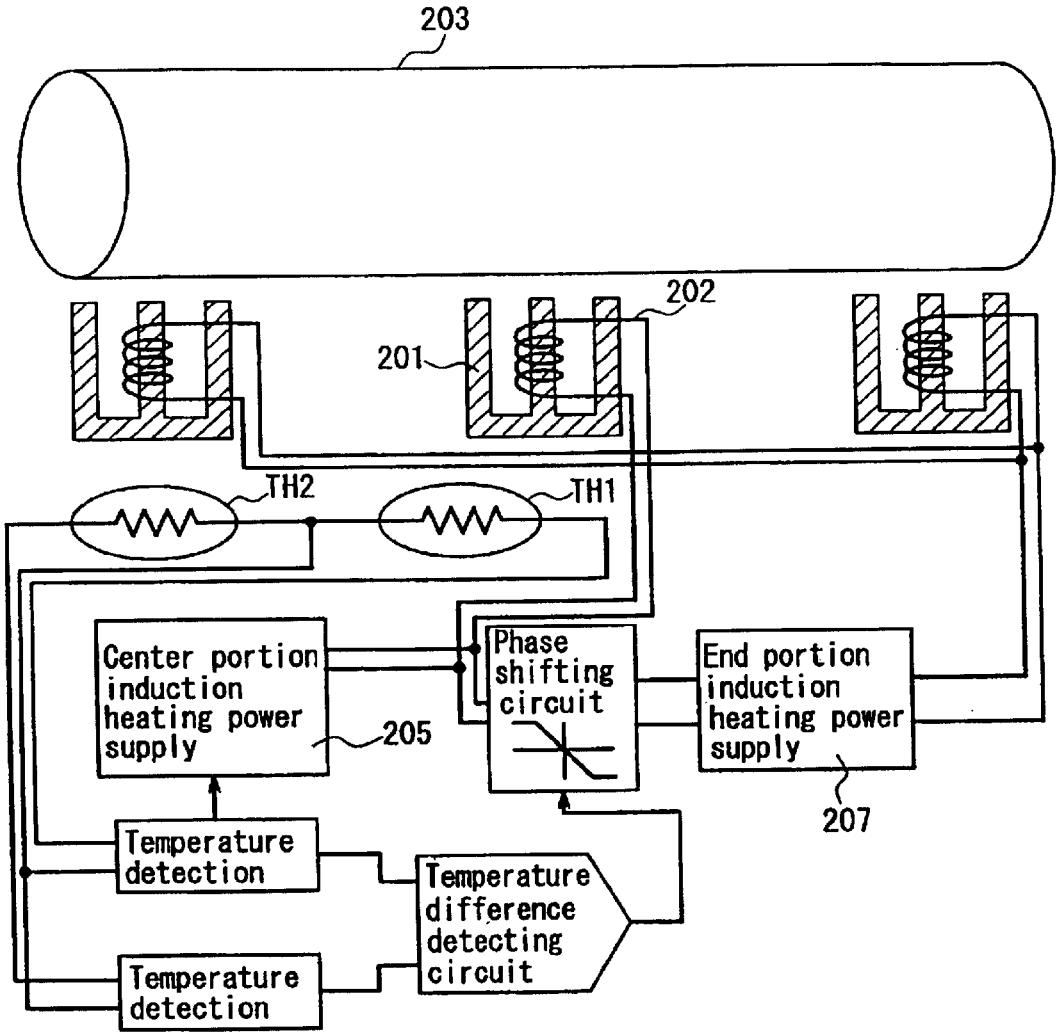
F I G. 2 9 PRIOR ART
FIG. 29 is a diagram showing a configuration of an induction heating circuit of an image heating device of a conventional image forming apparatus.

Furthermore, in the aforementioned example, the additional coil 7 was wound so that the adjacent turns of the wire bundle adhere to each other. However, as shown in FIG. 26, adjacent turns of the wire bundle may be wound so as to be spaced from each other. In this configuration, the length L2 of the area in which the additional coil 7 is provided can be increased using a smaller amount of wire. Thus, the effect of controlling a heat generation distribution, which is provided by an electric current induced in the additional coil 7, can be enhanced sufficiently. FIG. 26 shows an example in which the additional coil 7 shown in FIG. 24 is wound so that the respective turns of the additional coil 7 are apart from each other. However, using a configuration shown in FIG. 23, similarly, the additional coil 7 also can be wound so that the respective turns of the additional coil 7 are spaced from each other, thereby allowing the same effect to be attained.

Furthermore, a configuration also is feasible, in which the heat generating roller 1 is made thinner by being formed into a tube and provided with a supporting member for applying strength.

Furthermore, in a configuration shown in this embodiment, when passing paper sheets varying in size, passing was performed relative to one end portion of the heat generating roller 1 in the rotation axis direction. However, as in Embodiment 2, passing also can be performed relative to a center portion. In this case, the heat generation suppressing unit 40 including the additional coil 7 is provided on each end portion of the core 50.

As is obvious from Embodiments 1 to 6 described above, according to the present invention, an amount of heat generated by the heat generating roller 1 in the rotation axis direction can be controlled freely by the heat generation suppressing unit, and a temperature of the heat generating roller 1 in the rotation axis direction can be maintained uniformly. Thus, even when a paper sheet of a small width is passed, breakage and deterioration of constituent members are prevented from occurring due to a temperature rise in end portions.

Furthermore, even when a paper sheet of a maximum width is passed immediately after small-sized paper sheets are passed continuously, hot offset is not caused.

Moreover, heating also can be focused on an area corresponding to a paper width. In this case, the power consumption and temperature raising time can be reduced.

The heat generation suppressing unit of the present invention is not composed of members including a movable portion, thereby achieving a simple configuration. Thus, the apparatus can be reduced in size and weight and manufactured at lower cost.

The embodiments disclosed in this application are intended to illustrate the technical aspects of the invention and not to limit the invention thereto the invention may be embodied in other forms without departing from the spirit and the scope of the invention as indicated by the appended claims and is to be broadly construed.

What is claimed is:

1. An image heating device, comprising:

a heat generating member of a conductive material;

an excitation unit that is arranged in the vicinity of the heat generating member and generates an annular magnetic flux to cause the heat generating member to generate heat by electromagnetic induction; and a heat generation suppressing unit that suppresses heat generation of the heat generating member by suppressing the magnetic flux generated by the excitation unit;

wherein the heat generation suppressing unit includes a conductor that is arranged in a path of the annular magnetic flux generated by the excitation unit and induces a loop-shaped electric current linking to the magnetic flux under the magnetic flux.

2. The image heating device according to claim 1, wherein with respect to a common annular magnetic flux generated by the excitation unit, a plurality of the conductors are provided.

3. The image heating device according to claim 1, wherein the excitation unit includes an excitation coil that is arranged so as to be opposed to the heat generating member and a core of a magnetic material.

4. The image heating device according to claim 3, wherein the heat generation suppressing unit includes an additional coil wound around the core.

5. An image heating device, comprising:

a heat generating member of a conductive material with a rotatable cylindrical face;

an excitation unit that includes an excitation coil arranged so as to be opposed to the heat generating member and a core of a magnetic material and generates an annular magnetic flux to cause the heat generating member to generate heat by electromagnetic induction; and a heat generation suppressing unit that suppresses heat generation of the heat generating member by suppressing the magnetic flux generated by the excitation unit, wherein the excitation coil is formed of a wire that is wound, in end portions of the cylindrical face of the heat generating member in a rotation axis direction, along outer peripheral faces of the end portions, and in portions other than the end portions, along a generatrix direction of the cylindrical face;

the core is arranged so as to cover the excitation coil in a rotation direction of the cylindrical face, on an opposite side of the heat generating member with respect to the excitation coil;

the core includes a magnetically permeable portion opposed to the heat generating member through the excitation coil and an opposing portion opposed to the heat generating member without interposing the excitation coil between them; and the heat generation suppressing unit includes an additional coil wound around the core.

6. The image heating device according to claim 4 or 5, wherein both ends of the additional coil are short-circuited.

7. The image heating device according to claim 4 or 5, wherein the heat generation suppressing unit further includes a switching unit connected in series to the additional coil.

8. The image heating device according to claim 5, wherein the additional coil is wound around the magnetically permeable portion.

9. The image heating device according to claim 5, wherein the core includes a plurality of the magnetically permeable portions, and the additional coil is wound around at least one of the plurality of the magnetically permeable portions.

10. The image heating device according to claim 5, wherein a plurality of the additional coils are wound around the common magnetically permeable portion of the core.

11. The image heating device according to claim 4 or 5, wherein a pair of the additional coils are wound around the core, and the pair of the additional coils are wound in opposite directions.

12. The image heating device according to claim 4 or 5, wherein a pair of the additional coils are wound around the core, and the pair of the additional coils and a switching unit are connected in series.

13. The image heating device according to claim 4 or 5, wherein the additional coil is formed of a wire bundle of wires with insulated surfaces.

14. The image heating device according to claim 5, wherein the excitation coil is formed of a wire bundle of the wires with their surfaces insulated.

15. The image heating device according to claim 4 or 5, wherein with respect to a common annular magnetic flux generated by the excitation unit, a plurality of the additional coils are provided.

16. The image heating device according to claim 4 or 5, wherein the additional coil is arranged on an outer side of a passing area of a minimum-sized paper sheet.

17. The image heating device according to claim 7, wherein a plurality of the additional coils are arranged on an outer side of a passing area of a minimum-sized paper sheet, and the switching unit is switched over according to a width of a paper sheet to be passed.

18. The image heating device according to claim 7, further comprising a temperature detecting device, wherein the switching unit is switched over according to a temperature detected by the temperature detecting device.

19. The image heating device according to claim 7, wherein when no paper is passed, the switching unit is brought to an unconnected state, and after passing of paper is started, the switching unit is switched to a connected state.

20. The image heating device according to claim 7, wherein at temperatures lower than a set temperature, the switching unit is brought to an unconnected state, and after the set temperature is attained, the switching unit is switched to a connected state.

21. The image heating device according to claim 7, wherein at temperatures lower than a set temperature, the switching unit is switched over according to a width of a paper sheet to be passed.

22. The image heating device according to claim 5, wherein the core includes a plurality of substantially U-shaped cores, and the plurality of the U-shaped cores are arranged so as to cover the cylindrical face of the heat generating member in the rotation direction, at a distance from each other in the rotation axis direction of the heat generating member.

23. The image heating device according to claim 22, wherein the core further includes a second core portion that magnetically connects the plurality of the U-shaped cores, and the second core portion includes an opposing portion opposed to the heat generating member without interposing the excitation coil between them.

24. The image heating device according to claim 22, wherein only a portion of the plurality of the U-shaped cores is provided with the additional coil.

25. The image heating device according to claim 23, wherein substantially a center portion of the U-shaped core is connected to the second core portion.

26. The image heating device according to claim 22, wherein the U-shaped core is arranged so as to be inclined with respect to the rotation axis direction of the heat generating member.

27. The image heating device according to claim 5, wherein the core includes a plurality of substantially L-shaped cores, and the plurality of the L-shaped cores are arranged so as to cover the cylindrical face of the heat generating member in the rotation direction, at a distance from each other in the rotation axis direction of the heat generating member.

28. The image heating device according to claim 27, wherein the core further includes a second core portion that magnetically connects the plurality of the L-shaped cores, and the second core portion includes an opposing portion opposed to the heat generating member without interposing the excitation coil between them.

29. The image heating device according to claim 27, wherein only a portion of the plurality of the L-shaped cores is provided with the additional coil.

30. The image heating device according to claim 28, wherein one end portion of the L-shaped core is connected to the second core portion.

31. The image heating device according to claim 30, wherein the L-shaped cores are provided in a staggered arrangement with respect to the second core portion.

32. The image heating device according to claim 5, wherein the opposing portion of the core includes a convex portion protruding to a side of the heat generating member.

33. The image heating device according to claim 23 or 28, wherein the opposing portion of the second core portion includes a convex portion protruding to a side of the heat generating member, and the convex portion is inserted in a hollow portion in a winding center of the excitation coil.

34. An image heating device, comprising:

a heat generating member of a conductive material;

an excitation power supply that generates an electric current changing over time;

an excitation unit that is arranged in the vicinity of the heat generating member and supplied with the electric current from the excitation power supply to generate an annular magnetic flux so as to cause the heat generating member to generate heat by electromagnetic induction; and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current, wherein the switching unit is switched over when an induction current generated in the conductor has a value close to zero.

35. An image heating device, comprising:

a heat generating member of a conductive material;

an excitation power supply that generates an electric current changing over time;

an excitation unit that is arranged in the vicinity of the heat generating member and supplied with the electric current from the excitation power supply to generate an annular magnetic flux so as to cause the heat generating member to generate heat by electromagnetic induction; and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current, wherein the switching unit is switched over when an induction voltage generated in the conductor has a value close to zero.

36. The image heating device according to claim 34 or 35, wherein when switching over the switching unit, no electric current is applied to the excitation unit.

37. An image heating device, comprising:

a heat generating member of a conductive material;

an excitation power supply that generates an electric current and a voltage that change over time;

an excitation unit that is arranged in the vicinity of the heat generating member and supplied with the electric current and the voltage from the excitation power supply to generate an annular magnetic flux so as to cause the heat generating member to generate heat by electromagnetic induction; and a heat generation suppressing unit including a conductor that is arranged in a path of the annular magnetic flux generated by the excitation unit and induces a loop-shaped shaped electric current linking to the magnetic flux under the magnetic flux, and a switching unit for passing and interrupting the electric current, wherein the switching unit is switched over in synchronization with changes in the electric current or the voltage supplied to the excitation unit.

38. An image heating device, comprising:

a heat generating member of a conductive material;

an excitation power supply that generates an electric current changing over time;

an excitation unit that is arranged in the vicinity of the heat generating member and supplied with the electric current from the excitation power supply to generate an annular magnetic flux so as to cause the heat generating member to generate heat by electromagnetic induction; and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current, wherein the conductor is formed of a wire wound with at least one turn.

39. The image heating device according to claim 38, wherein the wire is wound with at least two turns whose paths are different from each other in at least a portion.

40. The image heating device according to claim 38, wherein the respective turns of the wire are wound apart from each other.

41. An image heating device, comprising:

a heat generating member of a conductive material;

an excitation power supply that generates an electric current changing over time;

an excitation unit that is arranged in the vicinity of the heat generating member and supplied with the electric current from the excitation power supply to generate an annular magnetic flux so as to cause the heat generating member to generate heat by electromagnetic induction; and a heat generation suppressing unit including a conductor that is arranged in a path of the annular magnetic flux generated by the excitation unit and induces a loop-shaped electric current linking to the magnetic flux under the magnetic flux, and a switching unit for passing and interrupting the electric current, wherein the conductor has a length in a direction along the annular magnetic flux that is greater than a thickness of the conductor in a plane perpendicular to the direction along the annular magnetic flux.

42. The image heating device according to claim 1, 5, 34, 35, 37, 38, or 41, wherein the heat generation suppressing unit suppresses the magnetic flux generated by the excitation unit by generating a magnetic flux in an opposite direction to a direction of the magnetic flux generated by the excitation unit.

43. The image heating device according to claim 1, 5, 34, 35, 37, 38, or 41, wherein the heat generation suppressing unit generates an induced electromotive force under the magnetic flux generated by the excitation unit to induce an electric current, so that a magnetic flux in a direction in which the magnetic flux generated by the excitation unit is cancelled out is generated.

44. The image heating device according to claim 1, 34, 35, 37, 38, or 41, wherein the conductor includes a hollow portion through which the magnetic flux is passed.

45. The image heating device according to claim 1, 34, 35, 37, or 41, wherein the conductor is formed of a wound wire.

46. The image heating device according to claim 1, 34, 35, 37, or 41, wherein the conductor is formed of a wound belt-like material.

47. The image heating device according to claim 1, 34, 35, 37, 38, or 41, wherein the conductor has an electric conductivity of not less than $1\times10^7$ [S/m].

48. The image heating device according to claim 1, 34, 35, 37, 38, or 41, wherein a magnetic material is provided on an inner side or in the vicinity of the conductor.

49. The image heating device according to claim 48, wherein a distance between an end portion of the magnetic material and the conductor along the annular magnetic flux is greater than a length of the conductor along the annular magnetic flux.

50. The image heating device according to claim 1, 34, 35, 37, 38, or 41, wherein the conductor is inclined with respect to the annular magnetic flux penetrating the conductor.

51. The image heating device according to claim 1, 5, 34, 35, 37, 38, or 41, further comprising a thin fixing belt and a fixing roller for suspending the fixing belt so that the fixing belt is suspended between the fixing roller and the heat generating member.

52. An image forming apparatus, comprising:

an image forming unit in which an unfixed image is formed on a recording material and carried by the recording material; and a thermal fixing device that thermally fixes the unfixed image on the recording material, wherein the thermal fixing device is the image heating device according to claim 1, 5, 34, 35, 37, 38, or 41.

53. An image heating device, comprising:

a heat generating member of a conductive material;

an excitation unit that is arranged in the vicinity of the heat generating member and generates an annular magnetic flux to cause the heat generating member to generate heat by electromagnetic induction; and a heat generation suppressing unit that suppresses heat generation of the heat generating member by suppressing the magnetic flux generated by the excitation unit;

wherein the excitation unit includes an excitation coil that is arranged so as to be opposed to the heat generating member and a core of a magnetic material; and the heat generation suppressing unit includes an additional coil wound around the core.

* * * * *